US008750736B2

(12) United States Patent
Nakamura et al.

(10) Patent No.: US 8,750,736 B2
(45) Date of Patent: Jun. 10, 2014

(54) IMAGE FORMING APPARATUS FOR OBTAINING GOOD IMAGE QUALITY OVER TIME

(75) Inventors: Keigo Nakamura, Kanagawa (JP); Haruo Iimura, Kanagawa (JP); Yasuhiko Ogino, Kanagawa (JP); Shinji Aoki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 147 days.

(21) Appl. No.: 13/415,077

(22) Filed: Mar. 8, 2012

(65) Prior Publication Data

US 2012/0243892 A1 Sep. 27, 2012

(30) Foreign Application Priority Data

Mar. 22, 2011 (JP) ..... 2011-063053

(51) Int. Cl.
*G03G 15/16* (2006.01)

(52) U.S. Cl.
USPC ..... 399/66; 399/121; 399/297; 399/302

(58) Field of Classification Search
USPC ..... 399/66, 121, 197, 302, 297
See application file for complete search history.

(56) References Cited

U.S. PATENT DOCUMENTS

| | | | | |
|---|---|---|---|---|
| 5,595,852 | A | 1/1997 | Shimoda et al. | |
| 5,799,226 | A * | 8/1998 | Shigeta et al. | 399/66 |
| 6,284,424 | B1 | 9/2001 | Iimura et al. | |
| 6,449,444 | B1 * | 9/2002 | Tanaka | 399/66 |
| 6,804,481 | B2 * | 10/2004 | Mochizuki et al. | 399/66 |
| 7,662,530 | B2 | 2/2010 | Iimura | |
| 7,742,729 | B2 * | 6/2010 | Sawai | 399/302 |
| 8,041,276 | B2 | 10/2011 | Ogino | |
| 8,045,875 | B2 | 10/2011 | Aoki et al. | |
| 2007/0178398 | A1 | 8/2007 | Ogino et al. | |
| 2008/0187857 | A1 | 8/2008 | Ogino et al. | |
| 2008/0267648 | A1 * | 10/2008 | Takayanagi | 399/66 |
| 2009/0123168 | A1 * | 5/2009 | Aoki et al. | 399/66 |
| 2009/0142087 | A1 | 6/2009 | Iimura | |
| 2010/0098446 | A1 | 4/2010 | Ishikawa et al. | |
| 2010/0232820 | A1 | 9/2010 | Usami et al. | |
| 2010/0284705 | A1 | 11/2010 | Aoki et al. | |

(Continued)

FOREIGN PATENT DOCUMENTS

| | | |
|---|---|---|
| JP | 4-86878 | 3/1992 |
| JP | 9-146381 | 6/1997 |

(Continued)

*Primary Examiner* — David Gray
*Assistant Examiner* — Francis Gray
(74) *Attorney, Agent, or Firm* — Oblon, Spivak, McClelland, Maier & Neustadt, L.L.P.

(57) ABSTRACT

An image forming apparatus includes an image carrying member to carry a toner image, a nip forming member to form a transfer nip with the image carrying member, and a transfer bias outputting unit to output a transfer bias to transfer the toner image from the image carrying member to a recording medium. The transfer bias is composed of a direct current (DC) component and an alternating current (AC) component, and a least one of the DC component and the AC component is subjected to constant voltage control. When constant current control is conducted at a timing other than when the toner image is being transferred from the image carrying member to the recording medium, a detection bias voltage at the transfer nip is detected, and the voltage of at least one of the DC component and the AC component is controlled based on the detected detection bias voltage.

16 Claims, 12 Drawing Sheets

(56) References Cited

U.S. PATENT DOCUMENTS

| | | | | |
|---|---|---|---|---|
| 2011/0058831 | A1* | 3/2011 | Usami et al. | 399/46 |
| 2011/0200348 | A1 | 8/2011 | Aoki | |
| 2011/0229168 | A1 | 9/2011 | Shiraishi et al. | |
| 2011/0255892 | A1 | 10/2011 | Aoki | |
| 2012/0045231 | A1* | 2/2012 | Ogino et al. | 399/45 |
| 2012/0045237 | A1* | 2/2012 | Aoki et al. | 399/66 |
| 2012/0045259 | A1 | 2/2012 | Nakamura et al. | |
| 2012/0237234 | A1* | 9/2012 | Sugimoto et al. | 399/50 |

FOREIGN PATENT DOCUMENTS

| | | |
|---|---|---|
| JP | 2006-267486 | 10/2006 |
| JP | 2008-58585 | 3/2008 |
| JP | 2008-185890 | 8/2008 |

* cited by examiner

FIG. 17

LL: LOW TEMPERATURE/LOW HUMIDITY
MM: MIDDLE TEMPERATURE/MIDDLE HUMIDITY
HH: HIGH TEMPERATURE/HIGH HUMIDITY

| | LL | | | | MM | | | | HH | | | |
|---|---|---|---|---|---|---|---|---|---|---|---|---|
| | COMPARISON EXAMPLE 1 | EXAMPLE 1 | EXAMPLE 2 | EXAMPLE 3 | COMPARISON EXAMPLE 1 | EXAMPLE 1 | EXAMPLE 2 | EXAMPLE 3 | COMPARISON EXAMPLE 1 | EXAMPLE 1 | EXAMPLE 2 | EXAMPLE 3 |
| DENSITY REPRODUCTION PERFORMANCE AT CONCAVE PORTION | 1 | 4 | 4 | 4 | 5 | 5 | 5 | 5 | 4 | 5 | 5 | 4 |
| DENSITY REPRODUCTION PERFORMANCE AT CONVEX PORTION | 4 | 5 | 4 | 4 | 5 | 5 | 5 | 5 | 5 | 5 | 5 | 5 |
| WHITE DOTS OCCURRING | 3 | 3 | 4 | 3 | 4 | 4 | 5 | 4 | 2 | 5 | 5 | 5 |

FIG. 18

| | | DENSITY REPRODUCTION PERFORMANCE AT CONCAVE PORTION | | | |
|---|---|---|---|---|---|
| | NUMBER OF PASSING SHEETS | COMPARISON EXAMPLE 2 | EXAMPLE 4 | EXAMPLE 5 | EXAMPLE 6 |
| 23°C/50% | 10K | 5 | 5 | 5 | 5 |
| ↓ | 20K | 4 | 5 | 4 | 5 |
| | 30K | 4 | 5 | 4 | 4 |
| | 40K | 3 | 4 | 4 | 5 |
| | 50K | 3 | 4 | 5 | 5 |
| | 60K | 3 | 5 | 4 | 5 |
| | 70K | 2 | 4 | 4 | 5 |
| | 80K | 2 | 4 | 4 | 4 |
| | 90K | 1 | 3 | 5 | 5 |
| 10°C/15% | 100K | 1 | 4 | 4 | 5 |

FIG. 19

LL: LOW TEMPERATURE/LOW HUMIDITY
MM: MIDDLE TEMPERATURE/MIDDLE HUMIDITY
HH: HIGH TEMPERATURE/HIGH HUMIDITY

| | LL | | MM | | HH | |
|---|---|---|---|---|---|---|
| | COMPARISON EXAMPLE 3 | EXAMPLE 7 | COMPARISON EXAMPLE 3 | EXAMPLE 7 | COMPARISON EXAMPLE 3 | EXAMPLE 7 |
| DENSITY REPRODUCTION PERFORMANCE AT CONCAVE PORTION | 2 | 4 | 5 | 5 | 4 | 5 |
| DENSITY REPRODUCTION PERFORMANCE AT CONVEX PORTION | 4 | 5 | 5 | 5 | 5 | 5 |
| WHITE DOTS OCCURRING | 3 | 4 | 4 | 4 | 2 | 4 |

$$\text{ABSOLUTE HUMIDITY } [kg/g^3] = \frac{217 \times \left(6.11 \times 10^{\left(7.5 \times \frac{t}{t+237.3}\right)}\right)}{t+273.15} \times \text{RELATIVE HUMIDITY} \times 0.01$$

IMAGE FORMING APPARATUS FOR OBTAINING GOOD IMAGE QUALITY OVER TIME

CROSS-REFERENCE TO RELATED APPLICATION

This application claims priority to Japanese Patent Application No. 2011-063053, filed on Mar. 22, 2011 in the Japan Patent Office, which is incorporated by reference herein in its entirety.

BACKGROUND

1. Technical Field

The present invention relates to an image forming apparatus such as a copier, a printer, a facsimile machine, a plotter, and a multi-functional apparatus including a plurality of functions.

2. Description of the Background Art

In image forming apparatuses using the electrophotographic method, an image carrying member, charged uniformly, is irradiated with light to form a latent image thereon, and the latent image is developed with toner as a toner image by a development unit. The toner image is then transferred to a recording medium such as a sheet and fused thereon, by which an image is formed on the recording medium. Such recording medium may be also referred to as recording material, recording sheet, transfer material, transfer sheet, or simply paper.

Recently, various new types of recording sheet are available for use, such as sheets having a leather article-like high-quality appearance, and "washi" (Japanese traditional paper). Typically, such recording sheets have a rough surface consisting of many small concavities and convexities produced by embossing to give the sheets their high-quality appearance. However, toner is generally hard to transfer to the concave portions compared to the convex portions. If the sheet surface is particularly rough, insufficient amounts of toner may be transferred to the concave portions, resulting in image failure such as voids.

In light of such problem, JP-2008-185890-A discloses a configuration in which a recording sheet is heated and charged with a polarity that is the opposite of the polarity of the charge on the toner just before transferring a toner image to the recording sheet, to increase the strength of a transfer electric field during the transfer process so that toner can be transferred to the concave portions. However, this method cannot compensate for very rough paper.

Further, JP-2006-267486-A, JP-2008-058585-A, JP-H09-146381-A, and JP-H04-086878-A disclose conventional configurations of image forming apparatuses superimposing alternating current (AC) voltage on direct current (DC) voltage to enhance transfer performance and to prevent image failures such as voids.

JP-2006-267486-A discloses a configuration which uses a transfer bias voltage having AC voltage superimposed on DC voltage, and further, before transferring a toner image to a recording sheet, the recording sheet is charged with a polarity opposite to the polarity of toner, depending on roughness of the surface of the recording sheet, to transfer the toner image to the concave portions.

JP-2008-058585-A discloses a configuration which uses a transfer bias voltage having AC voltage superimposed on DC voltage while setting the peak-to-peak AC voltage at twice the DC voltage or less.

JP-H09-146381-A discloses a configuration which uses an intermediate transfer member coated with fluoride resin on its surface, and a transfer bias voltage having AC voltage superimposed on DC voltage is applied while setting the peak-to-peak AC voltage to 2.05 times or more that of the DC voltage.

JP-H04-086878-A discloses a configuration which uses a transfer bias voltage having AC voltage superimposed on DC voltage while setting the frequency of AC voltage at 4 kHz (kilo Hertz) or less and the number of cycles in a transfer nip at twenty (20) times or more.

However, in the above-described methods, either the superimposed AC voltage is not enough to deposit sufficient toner in the concave portions of the surface of the recording medium or, in the case of constant voltage control to set the voltage at a constant level, the AC voltage is high, in which case the current may fluctuate greatly if component electrical resistance changes. That is, the resistance of component parts changes with environmental conditions or over time, causing the voltage to deviate from a suitable level and resulting images of poor quality. The above-described conventional techniques do not take into account such change in the resistance of component parts due to a change in environmental conditions.

SUMMARY

In one aspect of the present invention, an image forming apparatus is devised. The image forming apparatus includes an image carrying member to carry a toner image on a surface of the image carrying member; a nip forming member, contactable to the surface of the image carrying member carrying the toner image, to form a transfer nip between the nip forming member and the image carrying member; and a transfer bias outputting unit to output a transfer bias to set a transfer field at the transfer nip, the transfer bias transferring the toner image carried on the image carrying member to a recording medium passing through the transfer nip. When the toner image is transferred from the image carrying member to the recording medium, the transfer bias outputting unit outputs a transfer bias composed of a direct current (DC) component and an alternating current (AC) component, and a least one of the DC component and the AC component is subjected to constant voltage control. When constant current control is conducted at a timing other than when the toner image is being transferred from the image carrying member to the recording medium, a detection bias voltage at the transfer nip is detected, and the voltage of at least one of the DC component and the AC component is controlled based on the detection bias voltage detected during constant current control.

BRIEF DESCRIPTION OF THE DRAWINGS

A more complete appreciation of the disclosure and many of the attendant advantages and features thereof can be readily obtained and understood from the following detailed description with reference to the accompanying drawings, wherein:

FIG. 17 shows results of examples 1 to 3;

FIG. 18 shows results of examples 4 to 6;

FIG. 19 shows results of example 7;

Figure 1:
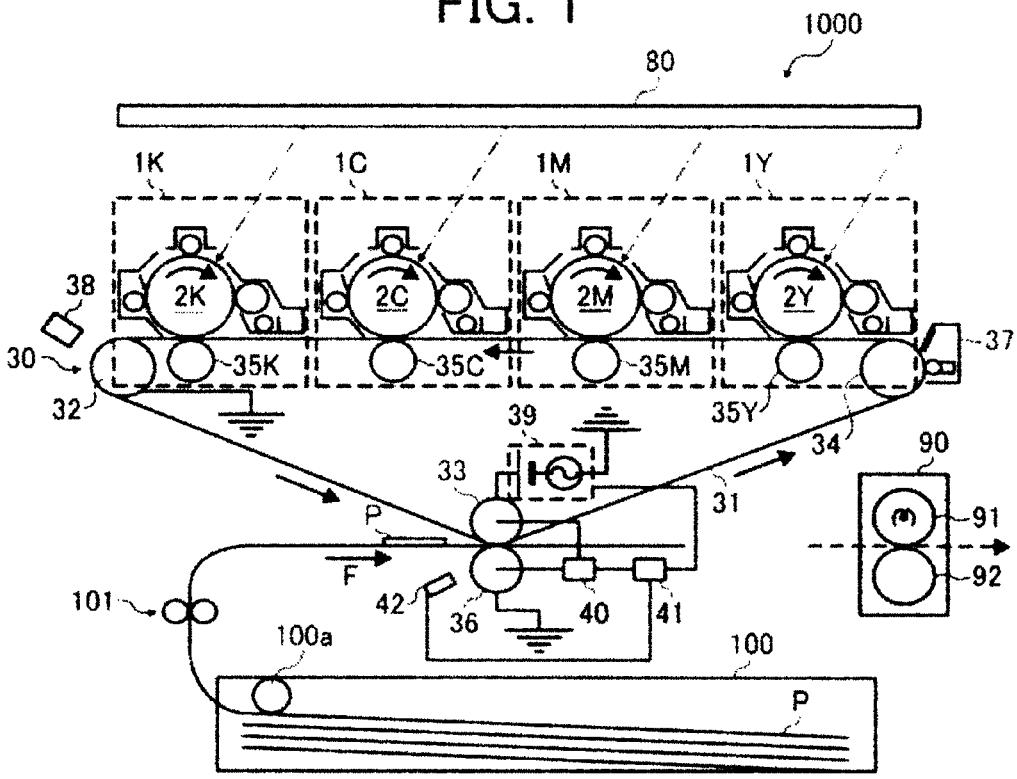
FIG. 1 shows a schematic configuration of an image forming apparatus according to an example embodiment.

The accompanying drawings are intended to depict exemplary embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION OF EXEMPLARY EMBODIMENTS

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing views shown in the drawings, specific terminology is employed for the sake of clarity, the present disclosure is not limited to the specific terminology so selected and it is to be understood that each specific element includes all technical equivalents that operate in a similar manner and achieve a similar result. Referencing now to the drawings, an apparatus or system for image forming process according to example embodiment is described hereinafter.

A description is given of a configuration of an image forming apparatus using electro-photographic method according to an example embodiment with reference to FIG. 1. The image forming apparatus 1000 may be a color printer, but not limited thereto. The image forming apparatus 1000 includes, for example, image forming units 1Y, 1M, 1C, 1K, a transfer unit 30, an optical writing unit 80, a fusing device 90, a sheet cassette 100, and registration rollers 101.

The image forming units 1Y, 1M, 1C, and 1K are used to form toner images of yellow (Y), magenta (M), cyan (C), and black (K) respectively. The image forming units 1Y, 1M, 1C, and 1K respectively uses Y, M, C, and K toner, different each other, as image forming material, but includes the same of similar configuration. The image forming units 1Y, 1M, 1C, and 1K can be replaced when the life time of units ends. Hereinafter, the image forming unit 1K for forming K toner image is explained as a representative of the image forming units 1Y, 1M, 1C, and 1K.

Figure 2:
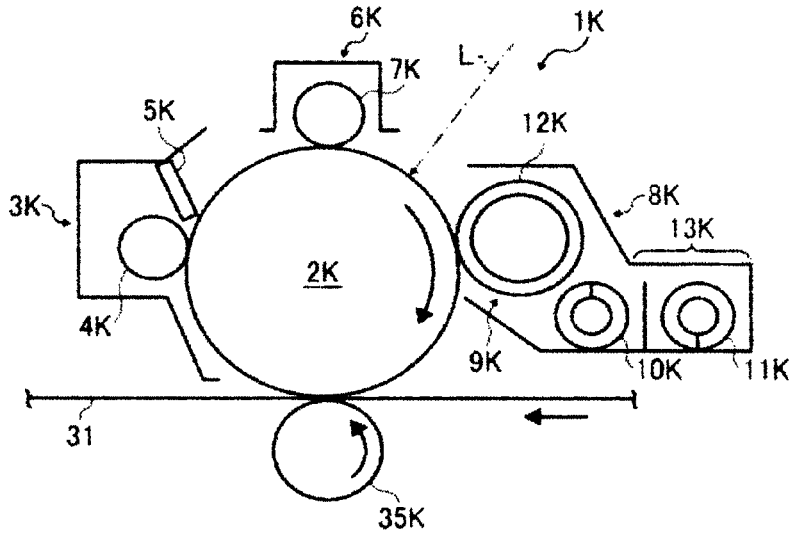
FIG. 2 shows a schematic configuration of an image forming unit used in the image forming apparatus of FIG. 1.

As shown in FIG. 2, the image forming unit 1K includes, for example, a photoconductor 2K, a drum cleaner 3K, a charging unit 6K, a development unit 8K, and a decharging unit. The photoconductor 2K, formed as drum shape, can be used an image carrying member to carry a latent image. These units of the image forming unit 1K can be placed in the same supporter structure such as a casing, and the image forming unit 1K can be detachably disposed in the image forming apparatus 1000, and these units of the image forming unit 1K can be replaced at the same time.

For example, the photoconductor 2K may be a drum constructed of a core and an organic photoconductive layer formed on the surface of drum core, and having an outer diameter of approximately 60 mm. The photoconductor 2K can be rotated by a driving unit in a clockwise direction in FIG. 2.

The charging unit 6K includes a charge roller 7K, to be applied with charging bias. The charge roller 7K is contacted or placed very close to the photoconductor 2K, by which discharge occurs between the charge roller 7K and the photoconductor 2K, and the surface of the photoconductor 2K is uniformly charged. In an example embodiment, the normal charging polarity of toner is set to the negative polarity, and the surface of the photoconductor 2K is uniformly charged to the same negative polarity as the toner. The charging bias is, for example, prepared by superimposing alternating current (AC) voltage to direct current (DC) voltage.

The charge roller 7K includes a metal core coated with an elastic and conductive layer of material. Alternatively, instead of the charge roller contacted or placed very closely to the photoconductor, a non-contact charger can be used as a charging member.

The surface of uniformly charged photoconductor 2K is scanned by a laser beam emitted from the optical writing unit 7 to form an electrostatic latent image of K on the photoconductor 2K. The electrostatic latent image of K is developed by the development unit 8K using K toner to form K toner image, and then transferred to an intermediary transfer belt 31 (primary transfer process), as described later.

The drum cleaner 3K removes toner remaining on the surface the photoconductor 2K after a primary transfer process at a primary transfer nip, to be described later, wherein such toner remaining on the surface may be referred to as remaining toner.

The drum cleaner 3K includes, for example, a cleaning brush roller 4K, and a cleaning blade 5K. The cleaning brush roller 4K can be rotated in a given direction. One end of the cleaning blade 5K is supported at a given portion of the drum cleaner 3K while other end of the cleaning blade 5K is used as a free end that can be contacted to the photoconductor 2K. Remaining toner can be removed from the surface of the photoconductor 2K by the cleaning brush roller 4K rotating in a given direction, and remaining toner can be scraped and removed from the surface of the photoconductor 2K by the cleaning blade 5K. The free end of cleaning blade 5K may be contacted in a counter direction with respect to the photoconductor 2K. Specifically, the supported end of the cleaning blade 5K comes to the downstream of the rotation direction of the drum with respect to the free end of cleaning blade 5K. After cleaning the photoconductor 2K by the drum cleaner 3K, the decharging unit decharges remaining charges on the photoconductor 2K to initialize the surface of the photoconductor 2K for a next image forming operation.

The development unit 8K includes, for example, a development section 12K including a development roll 9K, and a the developer transport section 13K to agitate and transport K developer agent.

The developer transport section 13K includes, for example, a first transport section including a first screw 10K, and a second transport section including a second screw 11K. Each of the first screw 10K and second screw 11K includes an axis rod and a spiral vane disposed on the axis rod. The both ends of axis rod can be rotatably supported by a bearing, and the spiral vane projects from the surface of the axis rod.

The first transport section having the first screw 10K and the second transport section having the second screw 11K are separated by a separation wall, wherein the separation wall is provided with a communication port at both ends of the separation wall to communicate the first and second transport section each other.

By rotating the first screw 10K, K developer agent present in the spiral vane is transported while being agitated in one direction in the first transport section. Because the first screw 10K and the development roll 9K are arranged in parallel with each other, the transport direction of K development agent is parallel to the axis direction of the development roll 9K. The first screw 10K supplies K developer agent onto the surface the development roll 9K along the axis direction of the development roll 9K.

When K development agent transported by the first screw 10K comes to one communication port provided at one end of the separation wall, K development goes into the second transport section, and then K development is present in the spiral vane of the second screw 11K. With the rotation of the second screw 11K, K developer agent present in the spiral vane is transported while being agitated in one direction in the second transport section.

A toner concentration sensor disposed at a lower side of a casing of the second transport section detects K toner concentration in K development agent in the second transport section. The toner concentration sensor may be a magnetic permeability sensor. Because K development agent includes K toner and magnetic carriers, the magnetic permeability of K development agent correlates to K toner concentration, and thereby the magnetic permeability sensor can detect K toner concentration.

As for the image forming apparatus 1000, the second transport section of the development unit of each of Y, M, C, K is provided with a toner supply unit of each of Y, M, C, K to supply Y, M, C, K toner, respectively.

A controller or control unit of the image forming apparatus 1000 stores a target voltage Vtref for toner concentration to a memory such as a random access memory (RAM). If the difference between an actual voltage output from the toner concentration sensor of Y, M, C, K and the Vtref of Y, M, C, K exceeds a given level, the toner supply units of Y, M, C, K are driven for a time corresponded to such difference to supply or refill Y, M, C, K toner to the second transport section of the development unit of each of Y, M, C, K.

The development roll 9K in the development section 12K faces the first screw 10K, and also faces the photoconductor 2K via an opening of the casing as shown in FIG. 2. The development roll 9K includes a magnet roller and a development sleeve disposed over the magnet roller. The development sleeve may be a non-magnetic pipe, rotatable in one direction. The magnet roller is fixed at a given position so that the magnet roller does not rotate with the development sleeve. K developer agent supplied from the first screw 10K can be carried on the surface of development sleeve with magnetic force of the magnet roller, and with the rotation of development sleeve, K developer agent is transported to a development area facing the photoconductor 2K.

The development sleeve is applied with a development bias having the same polarity of toner, and the potential of development bias is set greater than the potential of electrostatic latent image on the photoconductor 2K, and smaller than the potential of uniformly charged photoconductor 2K. Then, a development potential can be formed between the development sleeve and the electrostatic latent image on the photoconductor 2K, by which K toner on the development sleeve can be moved toward the electrostatic latent image electrostatically. Further, non-development potential can be formed between the development sleeve and a part of surface of the photoconductor 2K not having the electrostatic latent image, the non-development potential may move K toner on the development sleeve toward the surface of development sleeve. With such effect of the development potential and non-development potential, K toner on the development sleeve can be selectively transferred to the electrostatic latent image on the photoconductor 2K to develop the electrostatic latent image as K toner image.

As similar to the image forming unit 1K for K, at the image forming units 1Y, 1M, 1C for Y, M, and C, a toner image of Y, M, and C is respectively formed on the photoconductors 2Y, 2M, and 2C.

As shown in FIG. 1, the optical writing unit 80, used as a latent image writing unit, is disposed over the image forming units 1Y, 1M, 1C, 1K. Based on image information transmitted from an external device such as a personal computer, the optical writing unit 80 scans the photoconductors 2Y, 2M, 2C, and 2K using laser beams emitted from laser diodes to form an electrostatic latent image of Y, M, C, and K on each of the photoconductors 2Y, 2M, 2C, and 2K. Specifically, as for the surface of uniformly charged photoconductor 2Y, a portion of surface irradiated by the laser beam decreases its potential. As such, the potential of laser-irradiated portion becomes small compared to other portion not irradiated by the laser beam when an electrostatic latent image is formed.

The optical writing unit 80 includes a light source to emit laser L, and a polygon mirror driven by a polygon motor. The laser L is reflected by the rotating polygon mirror driven by the polygon motor, and a plurality of optical lenses and mirrors to scan the laser L on the photoconductor in a main scanning direction. The light source may be a light emitting diode (LED) array having a plurality of LEDs, which emit light.

As shown in FIG. 1, the transfer unit 30 is disposed under the image forming units 1Y, 1M, 1C, 1K. In the transfer unit 30, the intermediary transfer belt 31 such as an endless belt is extended and can be moved endlessly in a counter clockwise direction.

The transfer unit 30 includes, for example, the intermediary transfer belt 31 used as an image carrying member, a drive roller 32, a secondary transfer backside-roller 33, a cleaning backup roller 34, primary transfer rollers 35Y, 35M, 35C, 35K, a nip roller 36, a belt cleaning unit 37, and a potential detector 38.

The intermediary transfer belt 31 can be extended by the drive roller 32, the secondary transfer backside-roller 33, the cleaning backup roller 34, and the primary transfer rollers 35Y, 35M, 35C, 35K disposed inside the loop of the intermediary transfer belt 31. When the drive roller 32 is rotated in a counter clockwise direction in FIG. 1 by a driver, the intermediary transfer belt 31 can be moved endlessly in a counter clockwise direction in FIG. 1. For example, the intermediary transfer belt 31 may have following properties. The belt has a thickness of 20 μm to 200 μm, and preferably 60 μm or so. Further, the belt has a volume resistivity of 1E6 Ωcm to 1E12 Ωcm, and preferably 1E9 Ωcm or so measured by Highrester UP MCP HT 45 (trade name, manufactured by Mitsubishi Chemical Co.) with an application voltage of 100 V (volts). Further, the intermediary transfer belt 31 is, for example, made of carbon-dispersed polyimide resin.

The intermediary transfer belt 31, endlessly movable, is sandwiched between the primary transfer rollers 35Y, 35M, 35C, 35K and the photoconductors 2Y, 2M, 2C, 2K. The front face of the intermediary transfer belt 31 and the photoconductors 2Y, 2M, 2C, 2K form primary transfer nips for Y, M, C, K at a portion that the intermediary transfer belt 31 contacts the photoconductors 2Y, 2M, 2C, 2K.

When each of the primary transfer rollers 35Y, 35M, 35C, 35K is applied with the primary transfer bias from a transfer bias power source, a transfer electric field can be formed between the toner image of Y, M, C, K on the photoconductors 2Y, 2M, 2C, 2K and the primary transfer rollers 35Y, 35M, 35C, 35K.

Y toner image formed on the surface of the photoconductor 2Y comes to the primary transfer nip for Y as the photoconductor 2Y rotates. With the effect of the transfer electric field and the nip pressure, Y toner image is transferred from the photoconductor 2Y onto the intermediary transfer belt 31 (primary transfer process).

After Y toner image is transferred to the intermediary transfer belt 31, the intermediary transfer belt 31 passes the primary transfer nip for M, C, K sequentially, and M, C, K toner images are sequentially transferred to the intermediary transfer belt 31 from the photoconductors 2M, 2C, 2K while superimposed onto Y toner image. With such transfer process, an image having superimposed four color toner images is formed on the intermediary transfer belt 31.

Each of the primary transfer rollers 35Y, 35M, 35C, 35K may be an elastic roller including, for example, a metal core, and a conductive sponge layer fixed on the metal core, and the elastic roller has, for example, following properties. The elastic roller has an outer diameter of 16 mm, and the metal core has an outer diameter of 10 mm. Further, while pressing the sponge layer of the elastic roller using a metal roller having an outer diameter of 30 mm and earthed with a force of 10 N (Newton), the metal core of the primary transfer roller is applied with a current of 1000 V (volts). Based on Ohm's law (R=V/I), the computed resistance R of the sponge layer becomes about 3E7Ω. The primary transfer bias is applied to such primary transfer rollers 35Y, 35M, 35C, 35K by using a constant current control. Further, instead of the primary transfer rollers 35Y, 35M, 35C, 35K, a transfer charger or a transfer brush can be used.

In the transfer unit 30, the nip roller 36 may function as a nip forming member to form a secondary transfer nip. The nip roller 36 is disposed outside the loop of the intermediary transfer belt 31, and the secondary transfer backside-roller 33 is disposed inside the loop of the intermediary transfer belt 31 while facing the nip roller 36. The secondary transfer backside-roller 33 and the nip roller 36 sandwich the intermediary transfer belt 31, in which secondary transfer backside-roller 33 may function as a transfer member. With such configuration, the secondary transfer nip can be set between the nip roller 36 and the front face of the intermediary transfer belt 31, which can carry a toner image thereon, and the nip roller 36 and the intermediary transfer belt 31 may contact with each other at the secondary transfer nip.

While the nip roller 36 is earthed, the secondary transfer backside-roller 33 can be applied with a secondary transfer bias, supplied from a secondary transfer bias power source 39 functioning as a transfer bias outputting unit (or transfer bias application unit). With the effect of secondary transfer bias, a secondary transfer electric field can be formed between the secondary transfer backside-roller 33 and the nip roller 36. With the effect of secondary transfer bias, toner having the negative polarity can be electrostatically moved from the secondary transfer backside-roller 33 toward the nip roller 36.

As shown in FIG. 1, the sheet cassette 100 is disposed under the transfer unit 30. The sheet cassette 100 contains a plurality of stacked sheets as recording sheet P. In the sheet cassette 100, a sheet feed roller 100*a* contacts the top sheet in the sheet cassette 100. When the sheet feed roller 100*a* rotates, the recording sheet P is fed to a sheet path. The registration rollers 101 are disposed at the end of the sheet path. Upon sandwiching the recording sheet P at the registration rollers 101, the rotation of the registration rollers 101 is stopped. By synchronizing the timing that the intermediary transfer belt 31 having the toner image comes to the secondary transfer nip, the rotation of the registration rollers 101 is resumed to feed the recording sheet P to the secondary transfer nip.

At the secondary transfer nip, the toner image on the intermediary transfer belt 31 is contacted to the recording sheet P, and the toner image is transferred from the intermediary transfer belt 31 to the recording sheet P with the effect of the secondary transfer electric field and the nip pressure, and then a full color toner image is formed on the recording sheet P. The recording sheet P having the full color toner image on its surface passes the secondary transfer nip, and then separated from the nip roller 36 and the intermediary transfer belt 31 by self stripping.

The secondary transfer backside-roller 33 has, for example, following properties. The roller 33 has an outer diameter of 24 mm or so. Further, the metal core has an outer diameter of 16 mm or so. The surface of metal core is coated by a conductive rubber layer such as nitrile butadiene rubber (NBR), and the resistance R is 1E6Ω to 1E12Ω, preferably 4E7Ω or so. The resistance R can be measured as similar to the primary transfer roller.

Further, the nip roller 36 has, for example, following properties. The roller 36 has an outer diameter of 24 mm or so. Further, the metal core has an outer diameter of 14 mm or so. The surface of metal core is coated by a conductive rubber layer such as nitrile butadiene rubber (NBR), and the resistance R is 1E6Ω or less. The resistance R can be measured as similar to the primary transfer roller.

The secondary transfer bias power source 39 includes, for example, a direct current (DC) power source and an alternating current (AC) power source. The secondary transfer bias power source 39 can output a secondary transfer bias that superimposes AC voltage to DC voltage. Further, the secondary transfer bias power source 39 can be used by employing a constant current control.

The output terminal of the secondary transfer bias power source 39 is connected to the metal core of the secondary transfer backside-roller 33. The potential of the metal core of the secondary transfer backside-roller 33 is almost same as the output voltage from the secondary transfer bias power source 39. Further, the metal core of the nip roller 36 is earthed.

Further, instead of applying a superimposed bias to the metal core of the secondary transfer backside-roller 33 while the metal core of the nip roller 36 is earthed or grounded, the superimposed bias can be applied to the metal core of the nip roller 36 while the metal core of the secondary transfer backside-roller 33 is earthed or grounded, in which the nip roller 36 functions as a transfer member, and the polarity of DC voltage is set to a polarity opposite to the polarity of the toner.

Specifically, when the nip roller 36 is earthed as shown in FIG. 1, and toner having negative polarity is used, the superimposed bias is applied to the secondary transfer backside-roller 33, in which the DC voltage is set with the negative polarity as same as the negative polarity of toner, and set the time-average potential of the superimposed bias at the negative polarity as same as the toner.

In contrast, when the secondary transfer backside-roller 33 is earthed, the superimposed bias is applied to the nip roller 36, in which the DC voltage is set to the positive polarity opposite to the negative polarity of toner, and set the time-average potential of the superimposed bias at the positive polarity opposite to the negative polarity of the toner.

Further, instead of applying the superimposed bias to the secondary transfer backside-roller 33 or the nip roller 36, the DC voltage alone can be applied to one roller, and the AC voltage alone can be applied to other roller.

Figure 3:
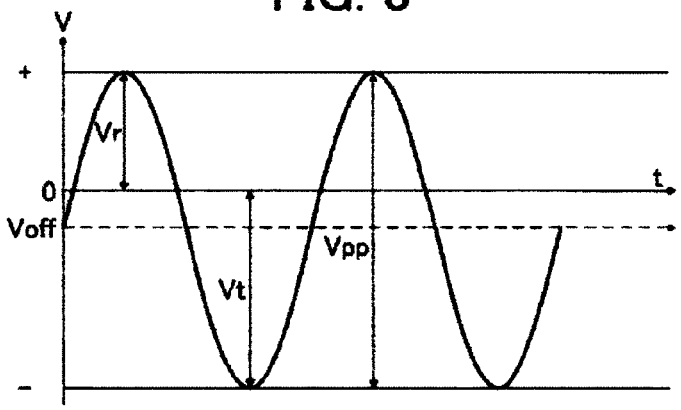
FIG. 3 shows an example wave pattern or profile of secondary transfer bias composed of superimposed bias voltage output from a secondary transfer bias power source.

As shown in FIG. 3, the wave pattern of AC voltage may be a sine wave, but a square wave can be also used. Further, if plain paper having small concave/convex portions on its surface is used as the recording sheet P, a dark/pale pattern corresponding to concave/convex portions may not occur, and thereby the transfer bias can be composed of only DC voltage. In contrast, if a rough-face paper having greater concave/convex portions on its surface is used as the recording sheet P, the transfer bias may require a superimposed bias.

As shown in FIG. 1, the image forming apparatus may further includes a voltage detector 40 connected to the nip roller 36 and the secondary transfer backside-roller 33. The voltage detector 40 detects potential at the secondary transfer nip when a constant current is applied from the secondary transfer bias power source 39. Such detected potential may be referred to as detection bias voltage or detection bias. In an example embodiment, the voltage detector 40 detects the detection bias voltage for eight times with 10 msec (milliseconds) interval, and sets a detection bias voltage by averaging the detected detection bias voltage.

When the secondary transfer bias power source 39 conducts a constant current control, the detection bias voltage detected by the voltage detector 40 is transmitted to a control unit 41. The control unit 41 computes the required AC voltage and/or DC voltage based on the detected detection bias voltage, and transmits the computed result to the secondary transfer bias power source 39 to control the secondary transfer process.

Further, a temperature and humidity sensor 42 is disposed near the nip roller 36 as a temperature and humidity detector to detect temperature and humidity around the secondary transfer configuration. The detected temperature and humidity result is transmitted to the control unit 41 to determine the environment near the nip roller 36.

After passing the secondary transfer nip, remaining toner not transferred to the recording sheet P is present on the intermediary transfer belt 31. Such remaining toner can be cleaned from the surface of intermediary transfer belt 31 using the belt cleaning unit 37 contactable to the intermediary transfer belt 31. The cleaning backup roller 34, disposed inside the loop of the intermediary transfer belt 31, backs up the belt cleaning process by the belt cleaning unit 37 from the inside of the loop.

The potential detector 38 is disposed outside the loop of the intermediary transfer belt 31 while distancing from the intermediary transfer belt 31 for about 4 mm and facing a portion of belt extended by the drive roller 32, which is earthed. When the toner image transferred on the intermediary transfer belt 31 comes to such facing portion, the potential detector 38 measures the surface potential of toner image. The potential detector 38 may be, for example, EFS-22D of TDK Corporation.

As shown in FIG. 1, the fusing device 90 is disposed after the secondary transfer nip. The fusing device 90 includes a fusing roller 91 and a pressure roller 92, and a fusing nip set between the fusing roller 91 and the pressure roller 92. The fusing roller 91 includes a heat source such as a halogen lamp, and the pressure roller 92, contacted and pressed to the fusing roller 91 with a given pressure, rotates in a given direction.

The recording sheet P is fed to the fusing nip of the fusing device 90 while facing the un-fused toner image to the fusing roller 91. With the effect of heat and pressure, toner in the toner image is softened, and the full-color image is fused on the recording sheet P. The recording sheet P ejected from the fusing device 90 is ejected outside of the image forming apparatus after passing the transport route.

When the monochrome image such as a black image is formed, a support plate supporting the primary transfer rollers 35Y, 35M, 35C in the transfer unit 30 is moved to separate from the primary transfer rollers 35Y, 35M, 35C from the photoconductors 2Y, 2M, 2C, by which the intermediary transfer belt 31 separates from the photoconductors 2Y, 2M, 2C, and contacts only to the photoconductor 2K. Under such condition, only the image forming unit 1K is activated to form K toner image on the photoconductor 2K.

FIG. 3 shows an example wave pattern of secondary transfer bias such as superimposed bias output from the secondary transfer bias power source 39. Such secondary transfer bias is applied to the metal core of the secondary transfer backside-roller 33 as described above. The secondary transfer bias power source 39, which is a voltage output unit, can function as a transfer bias application unit to apply transfer bias.

Further, as above described, when the secondary transfer bias is applied to the metal core of the secondary transfer backside-roller 33, a potential difference occurs between the metal core of the secondary transfer backside-roller 33 (used as a first member to set the secondary transfer nip) and the metal core of the nip roller 36 (used as a second member to set the secondary transfer nip), wherein such potential difference may be referred to as detection bias voltage or detection bias. Accordingly, the secondary transfer bias power source 39 can also function as a detection bias generator, which indicates the potential difference between the secondary transfer backside-roller 33 and the nip roller 36. Further, the detection bias voltage is typically treated as absolute value, but in an example embodiment, treated as a value having a given polarity.

Specifically, the detection bias voltage can be computed by subtracting the potential of the metal core of the nip roller 36 from the potential of the metal core of the secondary transfer backside-roller 33.

In an example embodiment using toner having negative polarity, if the time-average value of detection bias voltage becomes negative polarity, the potential of the nip roller 36 is set greater than the potential of secondary transfer backside-roller 33 while setting the positive polarity for the nip roller 36, which is opposite to the polarity of toner. In such configuration, toner can be electrostatically moved from the secondary transfer backside-roller 33 to the nip roller 36.

In FIG. 3, the offset voltage Voff corresponds to a direct current (DC) component of the secondary transfer bias. Further, the peak-to-peak voltage Vppt is a peak-to-peak voltage of alternating current (AC) component of the secondary transfer bias. As for the image forming apparatus 1000, as described above, the secondary transfer bias is prepared by superimposing the offset voltage Voff and peak-to-peak voltage Vpp, and the time-average of the secondary transfer bias is same as the offset voltage Voff. Further, as described above with reference to FIG. 1, the secondary transfer bias can be applied to the metal core of the secondary transfer backside-roller 33 while the metal core of the nip roller 36 is earthed (0 V).

Accordingly, the potential of the metal core of the secondary transfer backside-roller 33 becomes the potential difference of the metal core of the secondary transfer backside-roller 33 and the metal core of the nip roller 36. Further, the potential difference of the metal core of the secondary transfer backside-roller 33 and the metal core of the nip roller 36 is composed of a DC component (Eoff) corresponding to the offset voltage Voff, and an AC component (Epp) corresponding to the peak-to-peak voltage Vpp.

The offset voltage Voff having negative polarity (see FIG. 3) may be used for the image forming apparatus 1000. By setting the negative polarity for the offset voltage Voff, which is a component of the secondary transfer bias to be applied to the secondary transfer backside-roller 33, toner having the negative polarity can be pushed from the secondary transfer backside-roller 33 toward the nip roller 36 in the secondary transfer nip. As such, when the polarity of secondary transfer bias is set at the negative polarity, which is the same polarity of toner, toner having the negative polarity can be pushed from the secondary transfer backside-roller 33 toward the nip roller 36 electrostatically in the secondary transfer nip, by which a toner image formed on the intermediary transfer belt 31 is transferred to the recording sheet P.

In contrast, when the polarity of secondary transfer bias is set at the positive polarity, opposite to the polarity of the toner, toner having the negative polarity can be pushed from the nip roller 36 toward the secondary transfer backside-roller 33 electrostatically in the secondary transfer nip, by which toner transferred to the recording sheet P can be moved back to the intermediary transfer belt 31 again. In FIG. 3, because the time-average value of secondary transfer bias corresponds to the offset voltage Voff and has the negative polarity, toner can be pushed from the secondary transfer backside-roller 33 toward the nip roller 36 electrostatically as a whole.

When the secondary transfer bias is at a peak Vr, the peak Vr is at the positive polarity (see FIG. 3) opposite to the polarity of toner having the negative polarity.

Figure 4:
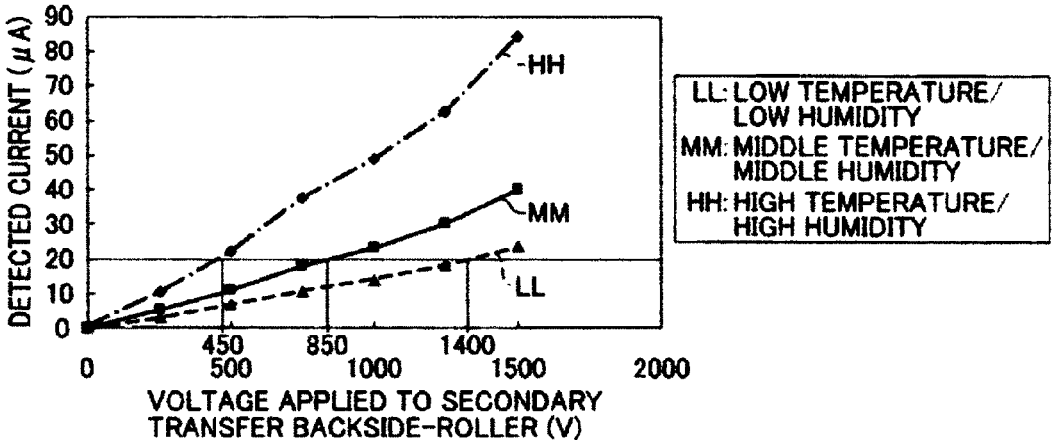
FIG. 4 shows relationship between applied voltage and current detected at a secondary transfer configuration.

The fluctuation of resistance of component parts used for forming the secondary transfer nip may be mainly caused by the change of environment conditions. FIG. 4 shows example profiles of current detected at the secondary transfer nip when DC voltage is applied to the secondary transfer backside-roller 33 under various environment conditions.

As shown in FIG. 4, when the environment is low temperature/low humidity (hereinafter, LL environment or LL), the resistance of component parts becomes high compared to the environment of middle temperature/middle humidity (hereinafter, MM environment or MM), and thereby the current flow with respect to the applied voltage becomes low.

In contrast, when the environment is high temperature/high humidity (hereinafter, HH environment or HH), the resistance of component parts becomes low compared to the MM environment, and thereby the current flow with respect to the applied voltage becomes high.

Accordingly, even if the same voltage is applied to secondary transfer backside-roller 33 under each LL, MM, and HH environment, the toner on the image carrying member is less likely transferred to a recording medium under LL environment because the transfer current is low, and in contrast, the discharge by over current may occur under HH environment because the transfer current is high.

Therefore, to flow the same transfer current under each environment, a voltage suitable for each environment is required to be selected. For example, when the current of 20 μA (micro amperes) is to be applied under each environment, based on the result shown in FIG. 4, the following voltage is required to be set for each environment: 1400 V for LL; 850 V for MM; and 450 V for HH. Because the relationship of current (I) and voltage (V) is defined as "V=RI," the fluctuation of resistance (R) causes voltage change at each environment even if the same current is applied under each environment.

Figure 5:
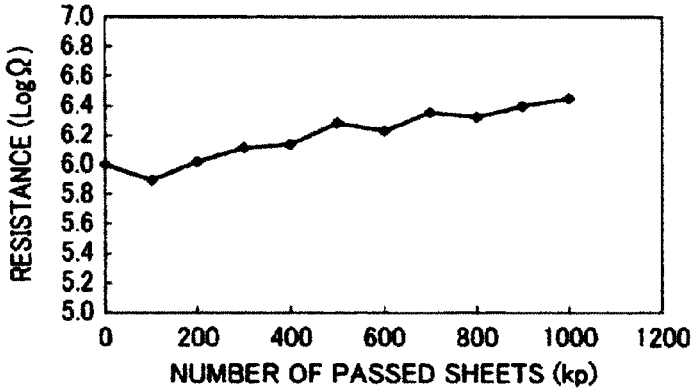
FIG. 5 shows an over-time fluctuation of resistance of a nip forming member depending on the numbers of sheet passing the secondary transfer configuration set by the nip forming member.

Further, the fluctuation of resistance may be caused by other reason such as resistance increase over time. FIG. 5 shows over-time fluctuation of resistance of the nip roller 36. As shown in FIG. 5, the resistance of the nip roller 36 fluctuates by repeating the sheet passing operations. As such, the resistance fluctuates for the secondary transfer configuration due to several reasons, and thereby a suitable voltage changes over time.

In view of such environmental conditions, in an example embodiment, before outputting images (e.g., printing images), a constant current control is conducted to flow the current from the secondary transfer backside-roller 33 to the nip roller 36 at a constant level. Then, based on the voltage obtained or detected (referred to as detection bias or detection bias voltage) by conducting the constant current control, the DC voltage and/or AC voltage are changed or adjusted to a suitable level, by which good image quality can be obtained constantly.

To obtain good image quality constantly over time, the constant current control may be preferably conducted at a given timing when the image carrying member is not used for an image forming operation, which may be referred to as image-not-forming timing.

Specifically, the constant current control may be conducted with a given interval. For example, when a continuous printing operation is conducted, a first time constant current control is conducted to set a transfer voltage for the secondary transfer configuration, and the transfer voltage is maintained at a given level until a given number of images (or recording sheets) passes the transfer nip (i.e., maintaining the transfer voltage at a constant level). When the given number of images passes the transfer position (e.g., images are formed on the given number sheets), a second time constant current control is conducted to determine a transfer voltage for the secondary transfer configuration again. With such configuration, good image quality constantly can be obtained over time.

Further, the constant current control may be conducted at a given timing. For example, a constant current control is conducted after completing one print job (i.e., job end timing), by which a next print job can be started without conducting another constant current control, and thereby the waiting time to activate the next print job can be shortened.

Further, the constant current control may be conducted at a given timing in view of fluctuation of the detected voltage. Specifically, when the detection bias voltage is detected for a number of times under the same environment, the detection bias voltages may not be exactly the same value but the fluctuation of detection bias voltages may be small. If the constant current control is conducted for such minor fluctuation of detection bias voltages, the processing load of the control unit 41 may become heavy. In view of reducing the processing load of the control unit 41, a reference voltage or default voltage is set for the detection bias voltage. Under such configuration, the voltage control is conducted only when the difference of the detection bias voltage and the reference voltage exceeds a given level, and further, a new reference voltage can be set when the detection bias voltage is detected at such timing, by which the processing load of the control unit 41 can be reduced.

Further, the constant current control may be conducted at a given timing in view of fluctuation of the resistance fluctuation of component parts. Because the resistance fluctuation of component parts is mainly caused by the change of environmental conditions, the voltage control may be conducted when the fluctuation of temperature and/or humidity exceeds a given level, wherein the environmental condition change or fluctuation can be determined by the temperature and humidity sensor 42 that detects temperature and humidity.

A description is given of a voltage control method according to an example embodiment. At first, a reference voltage used for the voltage control is searched and determined in advance. Specifically, the reference voltage may be a voltage which is detected when a given current (e.g., −20 μA) is applied under MM environment, a peak-to-peak voltage of AC voltage, and a median of DC voltage used for printing an image on a sheet having concave/convex portions (or rough surface).

In an example embodiment, the reference voltage is set based the result shown in FIG. 4. For example, the detected voltage Vdef of −0.85 kV corresponding to the applied current of −20 μA is used as the reference voltage. It should be noted that the applied current is not limited to any specific value. Then, black solid images were printed by changing the AC voltage and/or DC voltage, and then evaluated, in which sheets having a thickness of about 130 μm and concave/convex difference of about 70 μm ("sazanami" of FC Japanese paper of NBS Ricoh) were used.

The evaluation was conducted for three evaluation items: density reproduction performance (or reproducibility) at concave portion; density reproduction performance (or reproducibility) at convex portion, and emergence of white dots caused by discharge. A portion other than the concave portion (e.g., groove) on a sheet may be referred to as the convex portion or a top face portion of sheet because the convex portion of sheet does not include grooves or the like. For example, leather-like sheets have rough surface.

Figure 6:
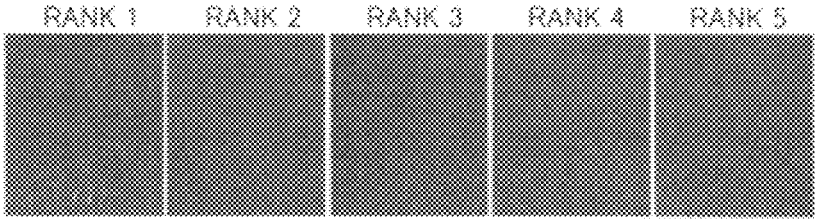
FIG. 6 shows evaluation results of density reproduction performance at concave portion ranked in different levels.

The density reproduction performance of concave portion is evaluated with following rankings by supplying enough amount of toner for the concave portion of sheets used for the test prints. When the image density at the concave portion is enough level, rank 5 is set. When a very limited area in the concave portion has white void, or when the image density at the concave portion is slightly low compared to the image density at the convex portion, rank 4 is set. When an area of white void becomes greater than rank 4, or when the image density becomes lower than rank 4, rank 3 is set. When the white void becomes greater than rank 3, or when the image density becomes lower than rank 3, rank 2 is set. When the concave portion becomes white as a whole and a groove-like area is clearly recognized, or the image condition is further deteriorated, rank 1 is set. FIG. 6 shows example black solid images at each rank. The allowable level of image quality for user is rank 4 or rank 5.

Figure 7:
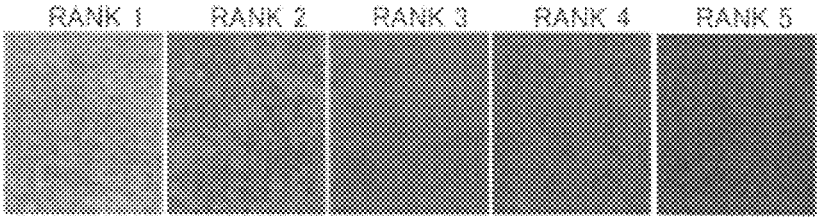
FIG. 7 shows evaluation results of density reproduction performance at convex portion ranked in different levels.

The density reproduction performance of convex portion is evaluated with following rankings. When the image density at convex portion is enough level, rank 5 is set. When the image density is slightly low compared to rank 5, but the image density level is acceptable for use, rank 4 is set. When the image density becomes low compared to rank 4, and the image density level causes image quality problem for user, rank 3 is set. When the image density becomes low compared to rank 3, rank 2 is set. When the convex portion becomes white as a whole, or when the convex portion becomes further white, rank 1 is set. FIG. 7 shows example black solid images at each rank. The allowable level of image quality for user is rank 4 or rank 5.

Depending on the levels of secondary transfer bias, discharge may occur in the secondary transfer nip, which is a very small space set between the concave portion on the surface of recording sheet P and the intermediary transfer belt 31, and white dots may be observed on images formed on the recording sheet P. The emergence of white dots caused by discharge is evaluated with following ranking.

Figure 8:
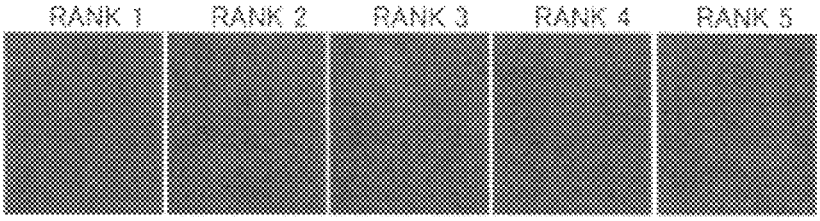
FIG. 8 shows evaluation results of white dots emergence ranked in different levels.

When the image has no white dots caused by discharge, rank 5 is set. When the image has some white dots, but the number of recognized white dots is small and the size of white dots is small, and the image quality is acceptable for user, rank 4 is set. When the number of recognized white dots becomes greater than that of rank 4 and the recognized white dots cause image quality problem, rank 3 is set. When the number of recognized white dots becomes greater than that of rank 3, rank 2 is set. When white dots are recognized in an entire image, and the image quality becomes worse than rank 2, rank 1 is set. FIG. 8 shows example black solid images at each rank. The allowable level of image quality for user is rank 4 or rank 5. Further, the white dot caused by discharge occurs as a spot while the concave portion as a whole becomes white when the density of concave portion is thin.

Figure 9:
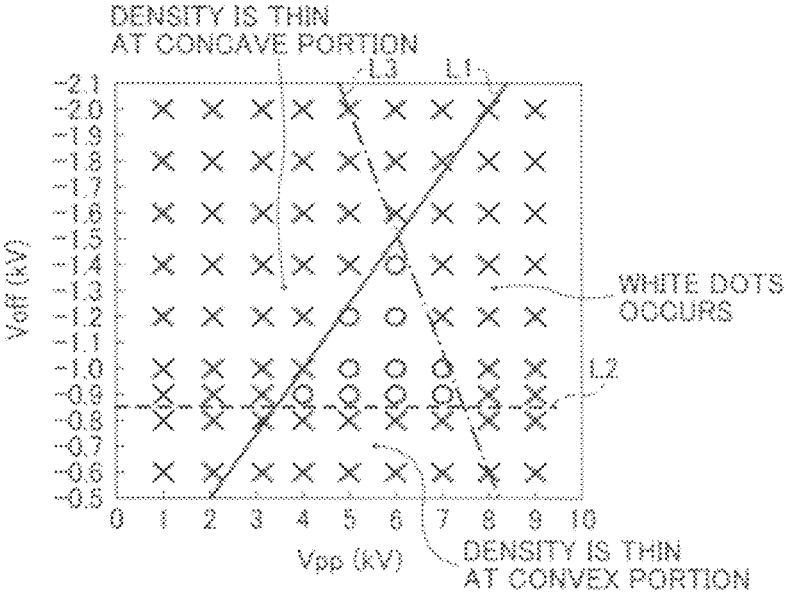
FIG. 9 shows evaluation results of density reproduction performance at concave portion and convex portion, and white dots emergence under middle temperature and middle humidity environment.

FIG. 9 shows evaluation results obtained by printing test patters on sheets, and a relation among the offset voltage Voff, the peak-to-peak voltage Vpp, the density reproduction performance of concave portions, the density reproduction performance of convex portion, and emergence of white dots. As shown in FIG. 9, the print test results were plotted in a two-dimensional coordinate system having the y axis representing the offset voltage Voff and the x axis representing the peak-to-peak voltage Vpp, and a line L1 (solid line), a line L2 (dotted line), and a line L3 (dashed line) are lined.

As shown in FIG. 9, in the left side area from the line L1, the test results of density reproduction performance of concave portions were obtained as not allowable level, which were plotted with "x." Further, in the area lower than the line L2, the test results of density reproduction performance of convex portion were obtained as not allowable level, which were plotted with "x." Further, in the right side area from the line L3, the test results of the emergence of white dots were obtained as not allowable level, which were plotted with "x."

In FIG. 9, the test results plotted by circle "O" indicate that all of the three evaluation items of (i) density reproduction performance of concave portions, (ii) density reproduction performance of convex portion, and (iii) emergence of white dots were at allowable levels. Therefore, the density reproduction performance of concave portions can be set at allowable levels using coordinate combinations of the offset voltage Voff and the peak-to-peak voltage Vpp encircled by the lines L1, L2, and L3 shown in FIG. 9. The relation of the peak-to-peak voltage Vpp and the offset voltage Voff that can obtain sufficient image density may be represented as "$Vpp>4\times|Voff|$." Therefore, if the secondary transfer bias satisfying the condition of "$Vpp>4\times|Voff|$" is used, sufficient image density can be obtained at the concave portions of sheet surface.

In a case of FIG. 9, the allowable range of AC voltage is from 4 kV to 8 kV, and the allowable range of DC voltage is from −0.9 kV to −1.5 kV, and the median of AC voltage becomes Vacdef=6 kV, and the median of DC voltage becomes Vdcdef=−1.2 kV. As such, by setting the peak-to-peak voltage of the AC component greater than absolute value of voltage of the DC component by at least four times or more, a good quality of images can be output. For example, when Vacdef=6 kV is divided by Vdcdef=−1.2 kV, it becomes five.

A description is given of voltage control methods useable for an example embodiment, in which voltage can be corrected using the following correction methods.

Correction Method A

In the correction method A, the greater the detection bias voltage, the peak-to-peak of AC voltage is set greater, and the absolute value of DC voltage is set greater (absolute value of DC voltage=absolute value of time-averaged value of transfer bias).

At first, a constant current of −20 μA is applied under the condition that no sheet is present in the secondary transfer nip (sheet not-passing condition), and then the voltage Va at such timing is measured. Based on the detected voltage Va (detection bias voltage) and the reference voltage Vdef for the transfer nip, Vacdef for AC, and Vdcdef for DC registered in advance, the AC voltage and DC voltage can be corrected as follows.

Peak-to-peak of AC voltage: $Vacdef\times(Va/Vdef)$

DC voltage: $Vdcdef\times(Va/Vdef)$

Correction Method B

Further, the voltage control of AC voltage and DC voltage can be conducted by changing the duty of AC voltage as follows to obtain good image quality. In the correction method B, the greater the detection bias voltage, the peak-to-peak of AC voltage is set greater, and the duty of AC voltage is changed to set the greater absolute value of time-average of transfer bias.

Peak-to-peak of AC voltage: $Vacdef\times(Va/Vdef)$

Figure 10:
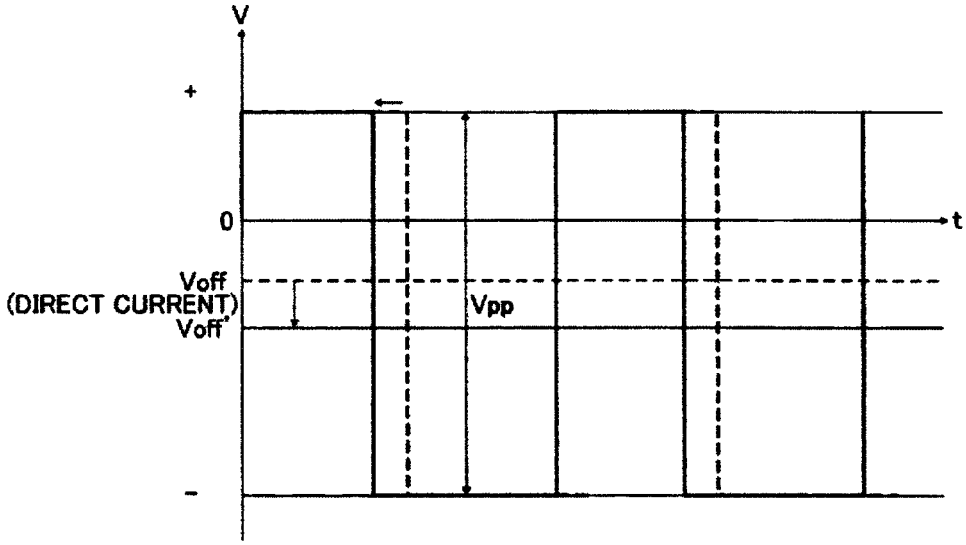
FIG. 10 shows example wave patterns of secondary transfer bias composed of superimposed bias voltage output from a secondary transfer bias power source, in which duty is changed.

Duty of AC voltage: $50+(Vdcdef\times(Va/Vdef-1))/(Vacdef\times Va/Vdef)\times 100$ FIG. 10 shows an example wave pattern of the secondary transfer bias settable by changing the duty of AC voltage. In FIG. 10, the solid line indicates after the duty change, and the dot line indicates before the duty change. By changing the duty of AC voltage, the time-average voltage of AC voltage changes, which has the same effect of changing DC voltage. Further, in FIG. 10, the duty of AC voltage is changed using a square wave, but a sine wave can be also used, in which the sine wave may be modified to an unsymmetrical wave to have the similar effect of the square wave.

Further, another voltage control method correcting Vt and Vr can be employed. In FIG. 3, "Vt" indicates a peak value of a pulse, which is used to form an electric field to move toner, charged to the normal polarity such as negative polarity, in a direction from the image carrying member toward the nip forming member in the second transfer nip.

Further, "Vr" indicates a peak value of a pulse, which is used to form an electric field to move toner, charged to the normal polarity such as negative polarity, in a direction from the nip forming member toward the image carrying member in the second transfer nip. Therefore, Vr can be used to electrostatically move toner having negative polarity from the nip roller 36 toward the secondary transfer backside-roller 33 in the secondary transfer nip.

Based on the experiments conducted by the inventors under various environment conditions, it has been found that when the resistance of component parts change or fluctuate, the AC voltage and the DC voltage are corrected while the correction amount of AC voltage and the correction amount of DC voltage are different with each other. Therefore, the correction of AC voltage and the correction of DC voltage are independently conducted with each other for image forming apparatuses. Because the correction amount of AC voltage and the correction amount of DC voltage are different, the correction amount of Vr and the correction amount of Vt becomes different with each other. Specifically, based on the experiments, it has been found that the fluctuation of Vr becomes smaller than the fluctuation of Vt (if the correction amount of AC voltage and the correction amount of DC voltage are same, the correction amount of Vr and the correction amount of Vt becomes same). Each of Vt and Vr is determined by including the fluctuation of DC voltage, and the AC and DC are independently changed as described above, and thereby the change level of Vt and the change level of Vr become different.

Correction Method C

Based on the experiments conducted by the inventors under various environment conditions, Vt_new and Vr_new can be computed as follows using the detection voltage Va (detection bias voltage) and the reference voltage Vdef at the transfer nip.

$Vt_new: Vt\times(Va/Vdef)$ $Vr_new: Vr\times(Va/Vdef)\times 0.8$

Then, the peak-to-peak of AC voltage and DC voltage are corrected as follows by using Vt_new and Vr_new.

Peak-to-Peak of AC voltage: $Vt$_new+$Vr$_new (kV)

DC voltage: ($Vt$_new+$Vr$_new)/2 (kV)

With such correction process, good image quality can be obtained.

A description is give of current/voltage application timing according to an example embodiment with reference to drawings.

Figure 11:
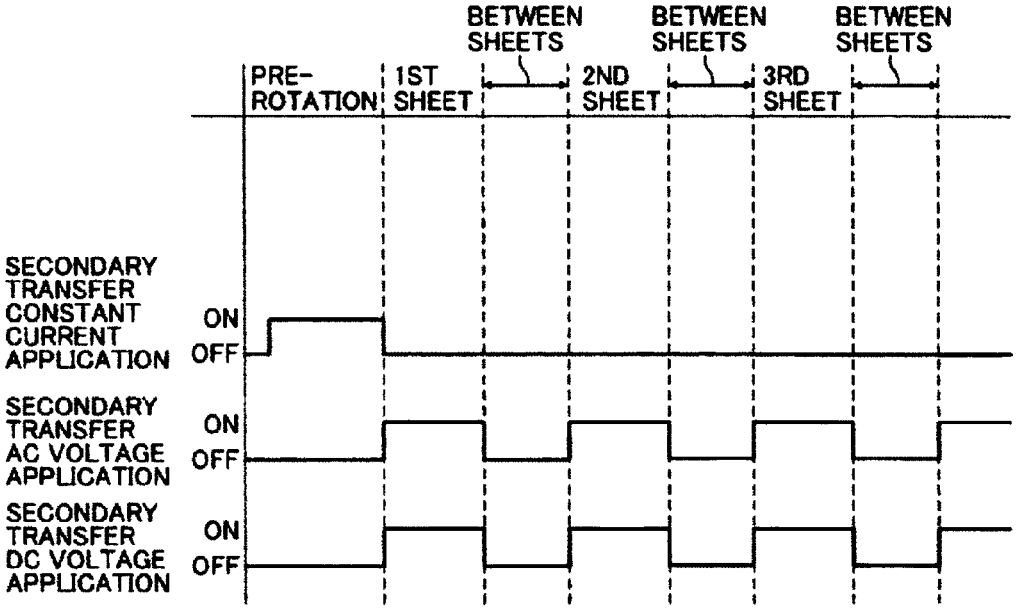
FIG. 11 is a timing chart of control operation for secondary transfer process.

FIG. 11 is one example of timing chart that the constant current control for the secondary transfer nip is conducted. As shown in FIG. 11, a constant current is applied when a sheet is not present in the transfer nip (sheet-not-present timing), and the DC voltage and AC voltage are applied when a sheet is present in the transfer nip (sheet-present timing). The sheet is not present in a transfer nip such as at a warming-up timing before starting printing operation or at a timing after completing one sheet printing and before starting next sheet printing.

Figure 12:
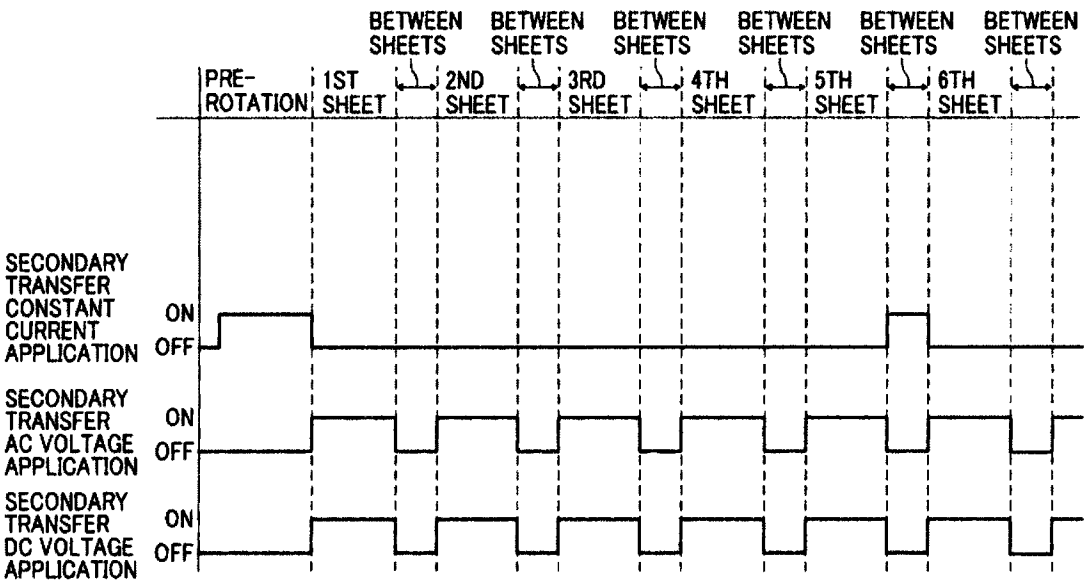
FIG. 12 is a timing chart of control operation for secondary transfer process, in which a control is conducted when continuous sheet passing operation is conducted.

FIG. 12 is one example of timing chart that the constant current control for the secondary transfer nip is conducted when the continuous sheet passing operation is conducted. In FIG. 12, the voltage correction is conducted by applying the constant current upon passing every five sheets through the secondary transfer nip. With such control, good image quality can be obtained when a printing operation is conducted by continuously supplying sheets. Further, the voltage control is not limited to every five sheets, but can be conducted for any number of sheets.

Figure 13:
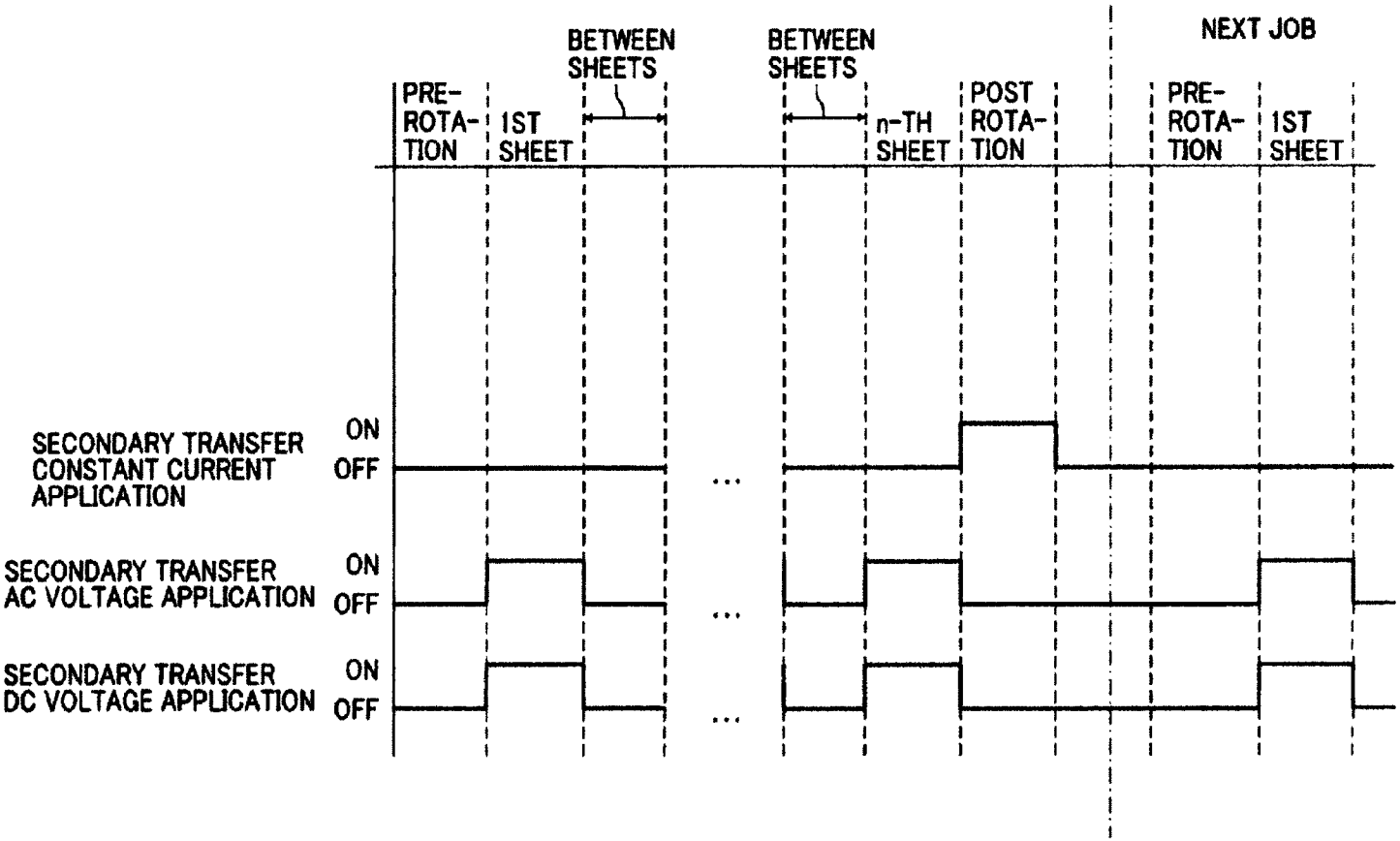
FIG. 13 is a timing chart of control operation for secondary transfer process, in which a control is conducted when one print job ends.
Figure 14:
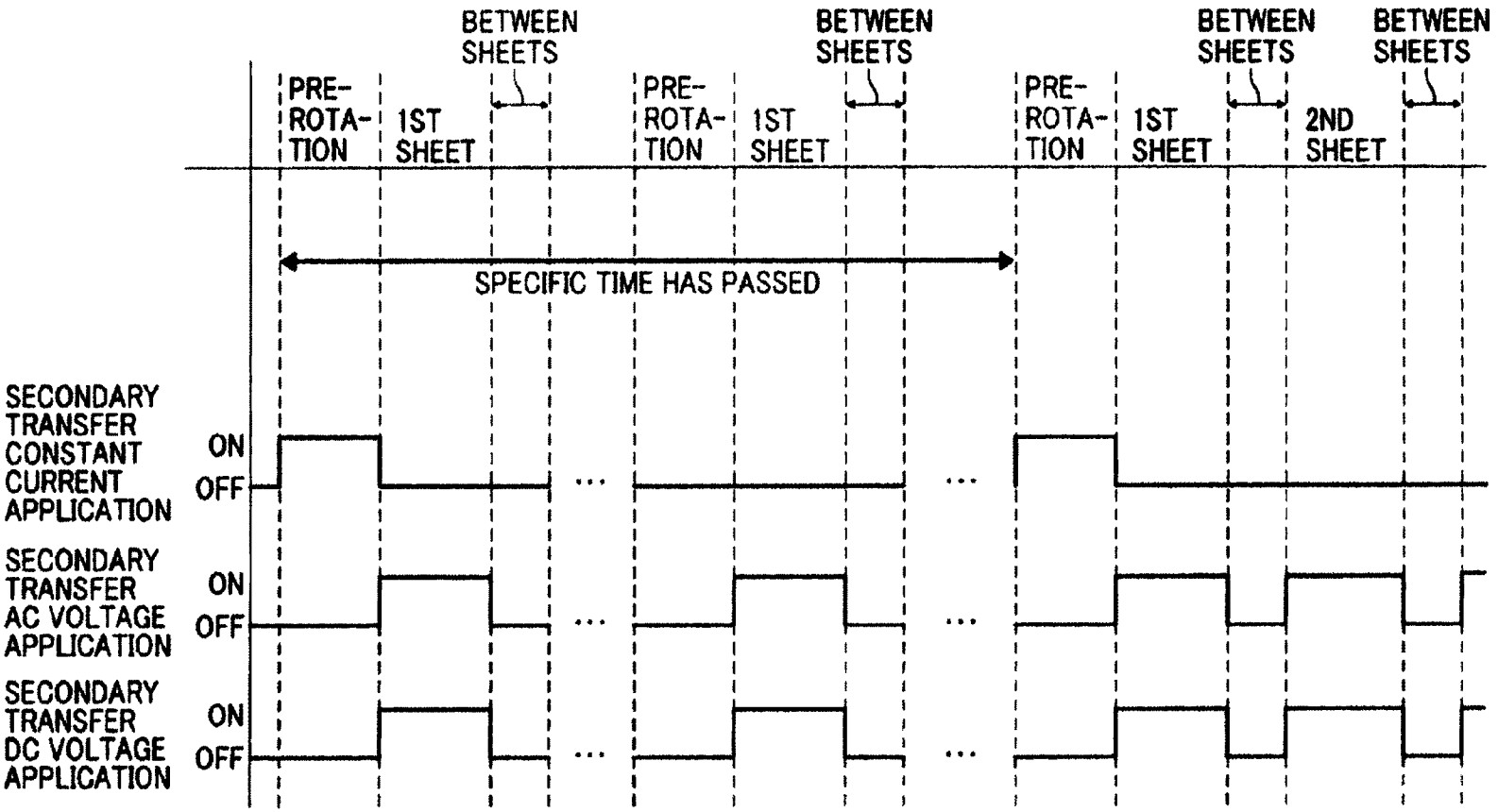
FIG. 14 is a timing chart of control operation for secondary transfer process, in which a control is conducted with a given time interval.

Further, FIGS. 13 and 14 show other timing charts of voltage application. FIG. 13 is one example timing chart that the constant current control for the secondary transfer nip is conducted after completing one print job. If the constant current control is conducted after completing one print job, the constant current control may no not be required when a next print job is to be started, by which the waiting time before conducting the next printing operation can be shortened, and thereby it can be shifted to the next printing operation quickly. Further, when to start the printing operation, other units used for image forming operation are also required to be activated and controlled, in which the processing load of controller such as CPU becomes heavy. By conducting the voltage control after completing one print job, the processing load of controller such as CPU can be reduced when to start a printing operation.

Further, if short print jobs, such as one sheet printing, are repeated and the constant current control is conducted for each print job, the voltage detection results are almost same between adjacently conducted print jobs, which may mean such frequently conducted constant current control may not be required.

FIG. 14 is one example timing chart that the constant current control for the secondary transfer nip is conducted when the short print jobs are repeated for a plurality of times. In this case, when a first time constant current control is conducted at a given timing, the next time constant current control is conducted after a given specific time T (seconds) elapses from the first time constant current control and before starting another print job. With such control, the constant current control is not conducted too many times in a short period of time, by which the voltage control can be conducted efficiently.

Further, the constant current control may be preferably conducted when the fluctuation of resistance of component parts exceeds a given level. For example, when the difference between the detection bias voltage and the reference voltage is small (i.e., voltage fluctuation is small), the constant current control may not be required. In an example embodiment, the constant current control can be conducted only when the difference between the detection bias voltage and currently-used reference voltage exceeds a given level such as ±0.05 kV or more, and the detection bias voltage and/or the corrected voltage can be used as new reference voltage.

Figure 15:
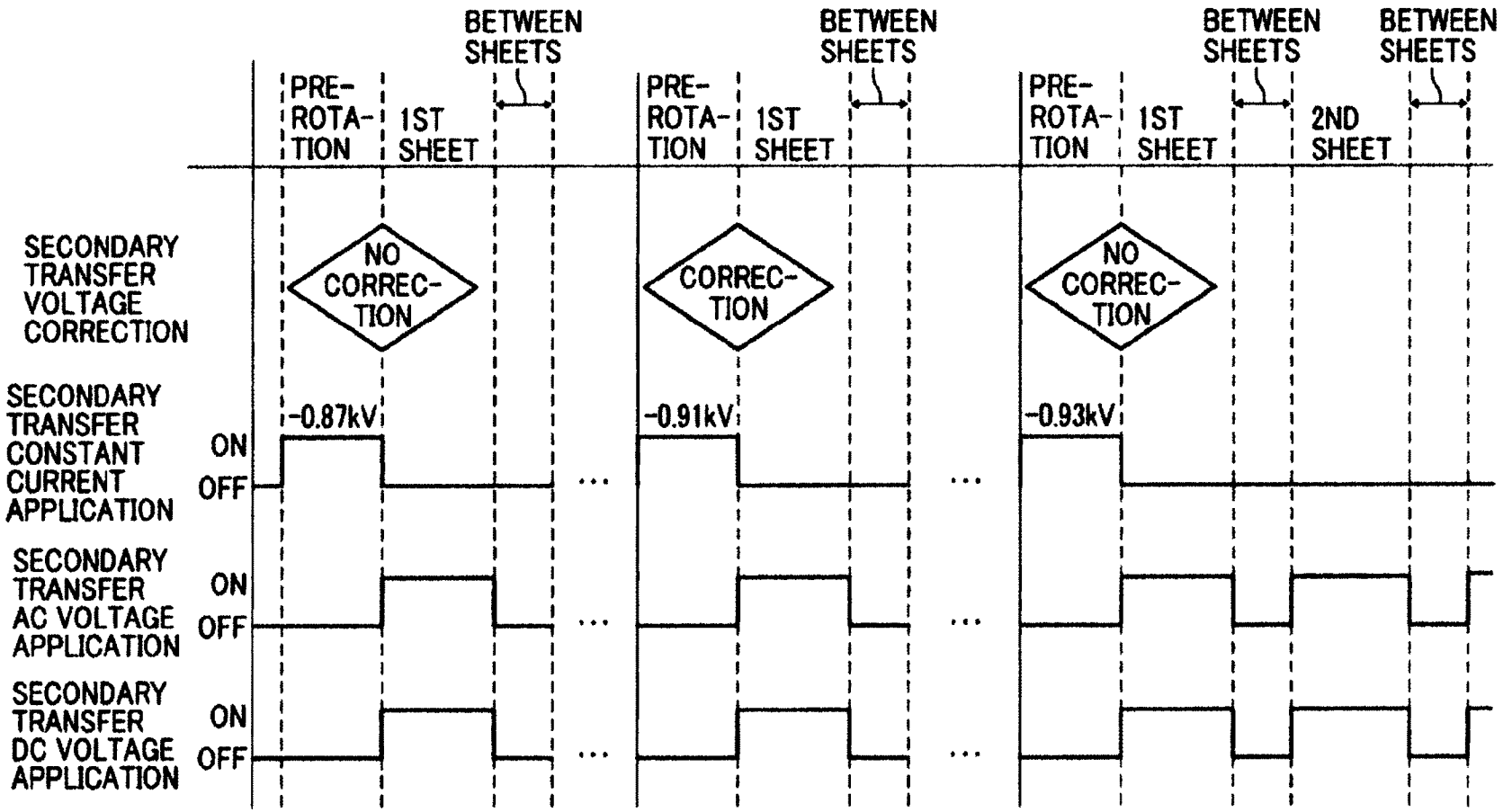
FIG. 15 is a timing chart of control operation for secondary transfer process, in which a control is conducted when a detection bias voltage fluctuates for a given amount.

FIG. 15 is one example timing chart that the constant current control for the secondary transfer nip is conducted when the fluctuation of resistance exceeds a given level. In FIG. 15, because a first time detection bias voltage is −0.87 kV, which is within the range of ±0.05 kV from the reference voltage, the voltage control is not conducted. When the voltage is detected for the second time, the detection bias voltage is −0.91 kV, which is outside the range of ±0.05 kV from the reference voltage, in which the voltage control is conducted, and the detection voltage of −0.91 kV is set as a new reference voltage. When the voltage is detected for the third time, the detection bias voltage is −0.93 kV, which is within the range of ±0.05 kV from the new reference voltage (i.e., −0.91 kV), and thereby the voltage control is not conducted. With such control, the reference voltage is not required to be changed too many times when the voltage fluctuation is small, by which the processing load of controller such as CPU can be reduced. Further, the fluctuation limit such as ±0.05 kV can be changed to other value.

Further, as above described, the resistance of component parts fluctuate mainly when the environment condition changes. Accordingly, the voltage control using the constant current control can be conducted efficiently and effectively by detecting the fluctuation of temperature and/or humidity with respect to a given reference level. In an example embodiment, the reference level of temperature and/or humidity is set as absolute humidity. The absolute humidity can be computed from detected temperature and relative humidity using formula shown in FIG. 20.

In a standard environment of 23 Celcius degrees/50% humidity, the absolute humidity becomes 10.30. In an example embodiment, the absolute humidity, which is detected when the power source is activated, is set as the reference level. When the absolute humidity, detected before conducting a print job exceeds, the range of "reference level±2" when to conduct a printing operation, the constant current control is conducted. Such "reference level±2" range may correspond to the fluctuation of about three (3) Celcius degrees for temperature, and the fluctuation of about ten percent (10%) for humidity.

Figure 16:
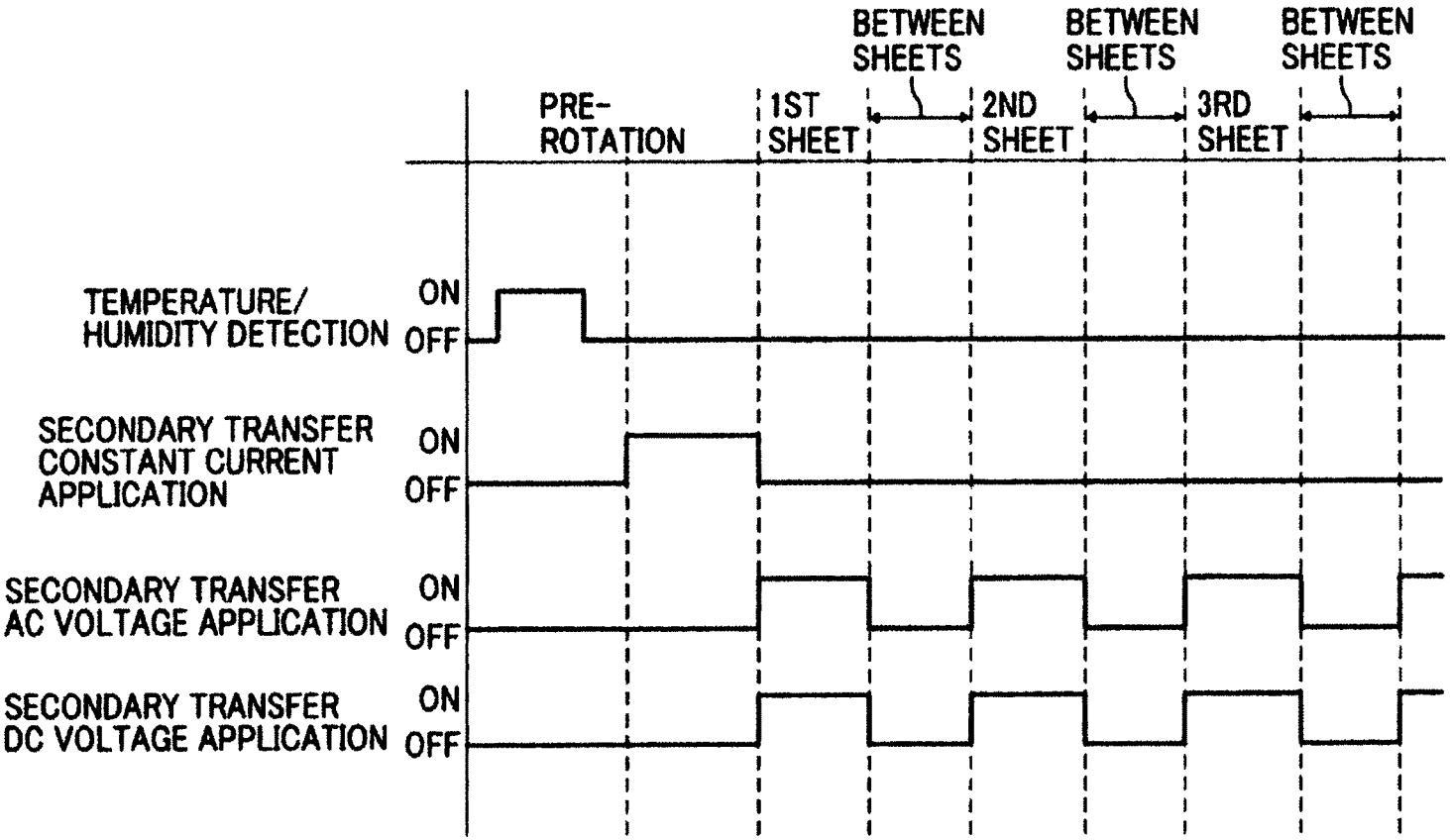
FIG. 16 is a timing chart of control operation for secondary transfer process, in which a control is conducted when temperature and humidity fluctuate for a given level.

FIG. 16 is one example timing chart that the constant current control for the secondary transfer nip is conducted by using the temperature/humidity detection. As shown in FIG. 16, the temperature and humidity may be detected when to start a print job. If detected the absolute humidity is not within the range of "reference level±2," the constant current control is conducted, and then the printing operation starts. With such control, the printing operation can be effectively conducted even if the temperature and humidity fluctuate, and the constant current control can be conducted only when the constant current control is required. Further, the fluctuation level is not limited to the "reference level±2," but other value can be set. Further, instead of using the fluctuation of absolute humidity, the fluctuation of temperature and/or relative humidity can be used to conduct the constant current control when the temperature and/or relative humidity fluctuate a given level or more.

Examples 1 to 3

A description is given of print test that the inventors conducted by using a test print machine having a configuration of image forming apparatus 1000. As for the print test, the development agent was prepared from toner and magnetic carrier, in which the toner having an average particle diameter of 6.8 μm was prepared from polyester by grinding, and the magnetic carrier having an average particle diameter of 55 μm was prepared by coating a resin layer on the surface of the magnetic carrier. Following detection bias voltage detected when the constant current is applied, DC voltage, and AC voltage were used as reference voltages.

Reference voltage of detection bias voltage: −0.85 kV

Reference voltage of DC voltage: −1.2 kV

Reference voltage of peak-to-peak of AC voltage: 6.0 kV

Vt and Vr was computed from such voltages as follows.

*Vt:* −4.2 kV

*Vr:* 1.8 kV

When the voltage control is conducted, AC voltage, DC voltage, and duty of AC voltage may be changed depending on the detection bias voltage as follows.

If |detection bias voltage|>|reference voltage| is detected, the DC voltage and the absolute value of peak-to-peak of AC voltage are increased while the duty of AC voltage is decreased at a level less than 50%.

If |detection bias voltage|<|reference voltage| is detected, the DC voltage and the absolute value of peak-to-peak of AC are decreased while the duty of AC voltage is increased to at a level more than 50%.

As shown in FIG. 4, for example, when the current of −20 μA was applied under LL environment, and the detection bias voltage was −1.4 kV, the AC voltage and DC voltage were corrected as follows using each correction method.

In the correction method A, the AC voltage and DC voltage were corrected as follows.

AC: $Vac'=6\times(-1.4/-0.85)=9.8$ kV

DC: $Vdc'=-1.2\times(-1.4/-0.85)=-1.98$ kV

In the correction method B, the peak-to-peak of AC voltage and duty of AC voltage were corrected as follows.

AC: $Vac'=6\times(-1.4/-0.85)=9.8$ kV $$\text{Duty}=50+(-1.2\times(-1.4/-0.85-1))/(8\times-1.4/-0.85)\times 100=44.1.$$

Further, in the correction method C, the voltages were corrected as follows.

$Vt$_new: $-4.2\times(-1.4/-0.85)=-6.9$ kV $Vr$_new: $1.8\times(-1.4/-0.85)\times 0.8=2.4$ kV Peak-to-peak of AC voltage: $|-6.9|+2.4=9.3$ kV DC voltage: $(-6.9+2.4)/2=-2.25$ kV.

Accordingly, if the absolute value of detection bias voltage becomes greater than the absolute value of the reference voltage, the absolute value of peak-to-peak of AC voltage and the absolute value of DC voltage are increased while the duty of AC voltage is decreased.

Further, for example, when the current of −20 μA was applied under HH environment, and the detection bias voltage was −0.45 kV (see FIG. 4), the AC voltage and DC voltage were corrected as follows using each correction method.

In the correction method A, the AC voltage and DC voltage were corrected as follows.

AC: $Vac'=6\times(-0.45/-0.85)=3.2$ kV

DC: $Vdc'=-1.2\times(-0.45/-0.85)=-0.64$ kV

In the correction method B, the peak-to-peak of AC voltage and duty of AC voltage were corrected as follows.

AC: $Vac'=6\times(-0.45/-0.85)=3.2$ kV $$\text{Duty}=50+(-1.2\times(-0.45/-0.85-1))/(8\times-0.45/-0.85)\times 100=63.3.$$

Further, in the correction method C, the voltages were corrected as follows.

$Vt$_new: $-4.2\times(-0.45/-0.85)=-2.2$ kV $Vr$_new: $1.8\times(-0.45/-0.85)\times 0.8=0.8$ kV Peak-to-peak of AC voltage: $|-2.21|+0.8=3.0$ kV DC voltage: $(-2.2+0.8)/2=-0.7$ kV Accordingly, if the absolute value of detection bias voltage becomes smaller than the absolute value of reference voltage, the absolute value of peak-to-peak of AC voltage and the absolute value of DC voltage are decreased while the duty of AC voltage is increased.

The voltage control was conducted using the control pattern shown in the timing chart of FIG. 12, in which the voltage correction was conducted every ten (10) printed sheets while continuously passing the printed sheets. The sheet passing condition was set with the frequency of 500 Hz and the line speed of 282 mm/s, and then black solid images were output on recording sheets, and then the visual inspection was conducted to evaluate the black solid images. Further, as for the recording sheets, sheets having a thickness of about 130 μm and concave/convex difference of about 70 μm ("sazanami" of FC Japanese paper of NBS Ricoh) were used.

Following comparison example and examples were prepared for the print test.

Comparison example 1: constant AC voltage and constant DC voltage were applied without voltage control Example 1: voltage corrected by correction method A Example 2: voltage corrected by correction method B Example 3: voltage corrected by correction method C For each of comparison example 1 and examples 1, 2, 3, the printing operation was conducted by passing sheets under LL, HH, and MM environment. Further, 100 sheets were printed for each sample under each environment, and the image evaluation was conducted based on the level of worst ranked image, in which the lowest image quality was evaluated whether the lowest image quality is acceptable or not. Three evaluation items were evaluated based on given evaluation standards. The three evaluation items include density reproduction performance at concave portion, density reproduction performance at convex portion, and emergence of white dots caused by discharge, and each evaluation item was evaluated with the evaluation standards using the ranks shown in FIGS. 5, 6, and 7.

FIG. 17 shows comparison example 1, and examples 1, 2, 3. As indicated in a table of FIG. 17, compared to comparison example 1, the evaluation results of examples 1, 2, and 3 indicate the improvement of the toner filling performance to grooves when sheets passed the secondary transfer nip under LL and HH environment, which indicates the effect of the above described example embodiment.

Examples 4 to 6

Furthermore, the following experiment was also conducted using the same configuration of example 1. The sheet passing condition was set with the frequency of 500 Hz and the line speed of 282 mm/s, and then black solid images were output on recording sheets, and then the visual inspection was conducted to evaluate the black solid images. Further, as for the printing condition, 100 sheets were printed by one print job, and such print job was repeated for 1,000 times continuously (i.e., print jobs were continued 1,000 times), and the visual inspection was conducted every 100-print jobs. The correction method A was used as the voltage correction method as similar to example 1. The constant current control was conducted using the control patterns of timing charts shown in FIGS. 14, 15, and 16. Following comparison example and examples were prepared for the print test.

Comparison example 2: constant AC voltage and constant DC voltage were applied without voltage control Example 4: constant current control was conducted at every given time interval (FIG. 14)

Example 5: constant current control was conducted when fluctuation of detection bias voltage exceeds a given level (FIG. 15)

Example 6: constant current control was conducted when fluctuation of temperature/humidity exceeds a given level (FIG. 16)

For each of comparison example 2 and examples 4, 5, 6, the printing operation was conducted by passing sheets under following environment. The experiment environment was set at MM environment such as 23 Celcius degrees/50% humidity when the experiment was started, and then the experiment environment was changed to LL environment such as 10 Celcius degrees/15% humidity over time.

Further, the following conditions were set for each example.

Example 4: T=10 (minutes) was set as time interval for voltage control

Example 5: constant current control was conducted when fluctuation of detection bias voltage becomes ±0.05 kV or more compared to the reference voltage Example 6: constant current control was conducted when fluctuation of detected absolute humidity becomes ±2 or more compared to the reference voltage of absolute humidity, in which temperature and humidity were detected.

FIG. 18 shows the evaluation result of density reproduction performance at concave portion. As indicated in FIG. 18, the rank became worse for comparison example 2 as the temperature fluctuates, while the rank were maintained at a good level for examples 4, 5, 6, which indicates the effect of above described example embodiment.

Example 7

Furthermore, the following experiment was conducted using the same configuration of example 1, in which the direct current component was applied with a constant current.

When a constant voltage or constant current is applied to a transfer portion, following features can be observed. When the constant voltage is applied, it is effective for variation of sheet size, but not so effective for the fluctuation of resistance of component parts, while when a constant current is applied, it is effective for fluctuation of resistance of component parts, but not so effective for variation of sheet size.

In example embodiment, when the resistance of component parts fluctuates, the level of an applied bias is changed. Therefore, in a case of constant current, the applied bias is not required to be changed.

Because the DC can be set at a constant current but the AC current cannot be set at a constant current, if the constant current is used for the DC, the correction is conducted only for AC. By supplying the DC component as constant current, correction of the DC is not required, and only the AC voltage is required to be corrected. The AC voltage can be corrected using the above described methods while not correcting DC voltage. Further, the voltage control was conducted using the control pattern shown in timing chart of FIG. 12 as similar to example 1. Further, the printing operation was conducted continuously by printing sheets, and the correction of voltage was conducted for every 10-sheets output. The DC current was applied using the current and voltage of MM environment such as about −1.2 kV and −26 μA (see FIG. 4). The sheet passing condition was set with the frequency of 500 Hz and the line speed of 282 mm/s, and then black solid images were output on recording sheets, and then the visual inspection was conducted to evaluate the black solid images.

Further, 100 sheets were printed for each sample under each environment, and the image evaluation was conducted based on the level of worst ranked image, in which the lowest image quality was evaluated whether the lowest image quality is acceptable or not. Following comparison example and example were prepared for the print test. Comparison example 3: constant AC voltage was applied without voltage control Example 7: voltage corrected by correction method A For each of comparison example 3 and example 7, the printing operation was conducted by passing sheets under LL, HH, and MM environment. FIG. 19 shows the evaluation results of comparison example 3 and example 7. As indicated in a table of FIG. 19, compared to comparison example 3, the evaluation results of example 7 indicate the improvement of the white dots caused by discharge, the toner filling to grooves when sheets were passed the secondary transfer nip under LL and HH, which indicates the effect of above described example embodiment when the DC component was set to a constant current.

Further, in the above described example embodiments, the transfer bias can be applied with following steps. In the method of controlling a transfer bias used for transferring images in an image forming apparatus, the image forming apparatus includes an image carrying member to carry a toner image on a surface of the image carrying member, a nip forming member, contactable to the surface of the image carrying member carrying the toner image, to form a transfer nip between the nip forming member and the image carrying member, and a outputting unit to output a transfer bias to set a transfer field at the transfer nip.

The transfer bias transfers the toner image carried on the image carrying member to a recording medium passing the transfer nip. The method includes the steps of outputting a transfer bias composed of direct current (DC) component and alternating current (AC) component, in which a least one of the DC component and the AC component is controlled by a constant voltage control; determining whether an activation of a constant current control is required when detection bias voltage is detected at the transfer nip at a given timing, excluding a timing when the toner image is transferred from the image carrying member to the recording medium, and adjusting at least one of voltage of the DC component and voltage of the AC component of the transfer bias when the detection bias voltage indicates the activation of the constant current control. Such method can be conducted as described above with reference to drawings showing various patterns for voltage/current application timing for the secondary transfer nip.

Further, the occurrence of the pitch irregularity in image can be prevented as follows. For example, the offset voltage Voff of −0.8 kV was used for the print test. Specifically, because the nip roller 36 forming the nip was earthed or grounded, the DC component of the secondary transfer bias composed of the superimposed bias was set at −0.8 kV. Also, as for the AC component, an AC component having a peak-to-peak voltage Vpp of 2.5 kV was used. The frequency f [Hz] of the AC component and a process linear velocity (the linear velocities of the intermediate transfer belt and the photosensitive elements) were changed, as required.

Under conditions different with each other for the frequency f and the process linear velocity, test images of black solid images were output on recording sheets such as plain paper. Then, the quality of the output black solid images was visually evaluated on a two-point scale. Cases where density irregularity (pitch irregularity) synchronized with the frequency of the AC component was not visible were marked with "o," and cases where density irregularity (pitch irregularity) synchronized with the frequency of the AC component was visible were marked with "x" in following Table 1.

TABLE 1

| Process Linear velocity | Frequency f [Hz] | | | | | | | | |
|---|---|---|---|---|---|---|---|---|---|
| [mm/s] | 50 | 100 | 200 | 300 | 400 | 500 | 600 | 700 | |
| 282 | x | x | x | x | ○ | ○ | ○ | ○ | Evaluation |
| 141 | x | x | ○ | ○ | ○ | ○ | ○ | ○ | |

As shown in Table 1, in a case that the process linear velocity "v" was set at 282 mm/s, it was possible to prevent occurrence of the pitch irregularity by setting the frequency f of the AC component at 400 Hz or greater. Also, in a case that the process linear velocity "v" was set at 141 mm/s, it was possible to prevent occurrence of the pitch irregularity by setting the frequency f of the AC component at 200 Hz or greater. The lower limit of the frequency "f" capable of preventing occurrence of the pitch irregularity changes depending on the process linear velocity "v" because the numbers of alternating electric field acting the toner in the secondary transfer nip changes depending on the process linear velocity "v."

Specifically, hereinafter, a nip width d [mm] is defined as length in a roller surface movement direction of the secondary transfer nip, formed by the direct contact of the intermediate transfer belt 31 and the nip roller 36 in a state that the recording sheet P is not inserted therebetween. A nip transit time [s] required for passing through the secondary transfer nip can be expressed in a formula of "nip width (d)/process linear velocity (v). Meanwhile, under the condition of the frequency "f" [Hz], the period [second] of the AC component of the superimposed bias can be expressed in a formula of "1/frequency (f)". Therefore, in the nip transit time, a one-period waveform of the AC component is applied by the number of times expressed by "(d×f/v)."

In the test print machine, the nip width d was 3 mm. As shown in Table 1, when the process linear velocity "v" was 282 mm/s, a required number of waveforms can be calculated about 4.26 (=3×400/282) because a lower limit of the frequency "f" capable of preventing an occurrence of the pitch irregularity is 400 Hz. This means that the occurrence of pitch irregularity can be prevented by applying the alternating electric field to the toner within the secondary transfer nip approximately by the number of times of 4.26.

In a case that the process linear velocity "v" was 141 mm/s, a required number of waveforms can be calculated about 4.26 (=3×200/141) because a lower limit of the frequency "f" capable of preventing an occurrence of the pitch irregularity is 200 Hz. This is the same value as that in the case of 400 Hz.

From these, it can be determined that it is possible to obtain a good image without the pitch irregularity by generating the alternating electric field about at least four times or more when the recording sheet P passes through the secondary transfer nip. In other words, in order to obtain a good image without the pitch irregularity, a condition of "4<d×f/v" may need to be satisfied.

Figures 20, 21:
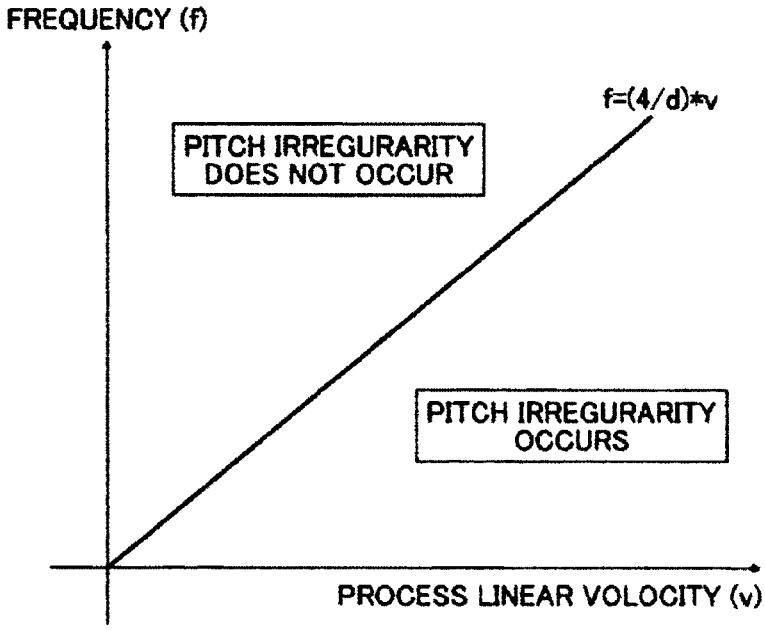
FIG. 20 shows a formula to compute absolute humidity from detected temperature and relative humidity.
FIG. 21 shows a graph illustrating a relation among the frequency of AC component of a secondary transfer bias composed of superimposed bias, process linear velocity, and pitch irregularity.

FIG. 21 is a graph illustrating a relation among the frequency "f" of the AC component of the secondary transfer bias composed of the superimposed bias, the process linear velocity "v", and the pitch irregularity. As shown in FIG. 21, in a two-dimensional coordinate system in which the y axis represents the frequency "f" and the x axis represents the process linear velocity "v", the pitch irregularity occurs in an area lower than a line represented by an equation of "f=(4/d)×v." In contrast, in an area upper than the line, occurrence of the pitch irregularity can be prevented.

Based on the above described experiment results, by conducting the constant current control and the detection bias voltage detected for the constant current control, the AC voltage and/or DC voltage to be applied to a transfer member when transferring an image can be computed, then the control processing in the image forming apparatus can be conducted even if the apparatus conditions and/or environment conditions change, by which good image quality can be obtained constantly.

As for the above described example embodiment, images having good quality can be preferably transferred to recording media having concave/convex portions or rough surface even if an apparatus conditions and environment conditions change. As for the above described example embodiment, direct current component can be applied as a constant current and only voltage of alternating current component may be controlled, by which the apparatus can be controlled simply. As for the above described example embodiment, a voltage suitable to resistance of component parts can be applied. As for the above described example embodiment, it can prevent the peak voltage becomes too high, and prevent abnormal images caused by discharge. As for the above described example embodiment, images can be preferably transferred to recording media by checking conditions before transferring images. As for the above described example embodiment, images without failure can be preferably transferred to recording media constantly even if print jobs are conducted for long time. As for the above described example embodiment, by conducting the voltage control after completing a print job instead of at a timing of starting a print job, the waiting time before conducting the next printing can be shortened. As for the above described example embodiment, the voltage control can be conducted efficiently by not controlling the voltage too many times in a short period of time. As for the above described example embodiment, the working load of CPU can be reduced by not conducting the voltage correction when voltages change in small values. As for the above described example embodiment, the voltage control can be conducted effectively even if resistance of component parts change due to a change of temperature and/or humidity. As for the above described example embodiment, images having good quality without image fluctuation, which may be caused by frequency change, can be obtained.

As above described, even if the conditions of apparatus such as environmental conditions change, a preferable transfer bias can be set by setting preferable alternating current (AC) voltage and/or preferable direct current (DC) voltage, by which image forming apparatuses can preferably transfer images with good quality constantly.

The present invention can be implemented in any convenient form, for example using dedicated hardware, or a mixture of dedicated hardware and software. The present invention may be implemented as computer software implemented by one or more networked processing apparatuses. The network can comprise any conventional terrestrial or wireless communications network, such as the Internet. The processing apparatuses can compromise any suitably programmed apparatuses such as a general purpose computer, personal digital assistant, mobile telephone (such as a Wireless Application Protocol (WAP) or 3G-compliant phone) and so on. Since the present invention can be implemented as software, each and every aspect of the present invention thus encompasses computer software implementable on a programmable device. The computer software can be provided to the programmable device using any storage medium for storing processor readable code such as a flexible disk, a compact disk read only memory (CD-ROM), a digital versatile disk read only memory (DVD-ROM), DVD recording only/rewritable (DVD-R/RW), electrically erasable and programmable read only memory (EEPROM), erasable programmable read only memory (EPROM), a memory card or stick such as USB memory, a memory chip, a mini disk (MD), a magneto optical disc (MO), magnetic tape, a hard disk in a server, a solid state memory device or the like, but not limited these.

The hardware platform includes any desired kind of hardware resources including, for example, a central processing unit (CPU), a random access memory (RAM), and a hard disk drive (HDD). The CPU may be implemented by any desired kind of any desired number of processor. The RAM may be implemented by any desired kind of volatile or non-volatile memory. The HDD may be implemented by any desired kind of non-volatile memory capable of storing a large amount of data. The hardware resources may additionally include an input device, an output device, or a network device, depending on the type of the apparatus. Alternatively, the HDD may be provided outside of the apparatus as long as the HDD is accessible. In this example, the CPU, such as a cache memory of the CPU, and the RAM may function as a physical memory or a primary memory of the apparatus, while the HDD may function as a secondary memory of the apparatus.

In the above-described example embodiment, a computer can be used with a computer-readable program, described by object-oriented programming languages such as C++, Java (registered trademark), JavaScript (registered trademark), Perl, Ruby, or legacy programming languages such as machine language, assembler language to control functional units used for the apparatus or system. For example, a particular computer (e.g., personal computer, work station) may control an information processing apparatus or an image processing apparatus such as image forming apparatus using a computer-readable program, which can execute the above-described processes or steps. In the above described embodiments, at least one or more of the units of apparatus can be implemented in hardware or as a combination of hardware/software combination. In example embodiments, processing units, computing units, or controllers can be configured with using various types of processors, circuits, or the like such as a programmed processor, a circuit, an application specific integrated circuit (ASIC), used singly or in combination.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

What is claimed is:

1. An image forming apparatus, comprising:

an image carrying member configured to carry a toner image on a surface of the image carrying member;

a nip forming member, contactable to the surface of the image carrying member carrying the toner image, configured to form a transfer nip between the nip forming member and the image carrying member; and a transfer bias outputting unit configured to output a transfer bias to set a transfer field at the transfer nip, the transfer bias transferring the toner image carried on the image carrying member to a recording medium passing through the transfer nip, wherein, when the toner image is transferred from the image carrying member to the recording medium, the transfer bias outputting unit is configured to output a transfer bias composed of a direct current (DC) component and an alternating current (AC) component, a least one of the DC component and the AC component subjected to a constant voltage control, and wherein when a constant current control is conducted at a timing other than when the toner image is being transferred from the image carrying member to the recording medium, a detection bias voltage at the transfer nip is detected, wherein the voltage of at least one of the DC component and the AC component is controlled based on the detection bias voltage detected during constant current control.

2. The image forming apparatus of claim 1, wherein the detection bias voltage at the transfer nip and a preset reference voltage for the transfer nip are compared, and at least one of the DC component and the AC component of the transfer bias is controlled based on a comparison of the detection bias voltage and the preset reference voltage.

3. The image forming apparatus of claim 1, wherein peak-to-peak voltage of the AC component and the voltage of the DC component of the transfer bias are controlled based on the voltage of the detection bias voltage at the transfer nip.

4. The image forming apparatus of claim 3, wherein the greater the absolute value of the detection bias voltage detected at the transfer nip, the greater the peak-to-peak voltage of the AC component and the greater absolute value of voltage of the DC component.

5. The image forming apparatus of claim 1, wherein the AC component includes a pulse having a peak Vt and a peak Vr to form an electric field to move toner charged to normal polarity in the transfer nip, wherein at the peak Vt, an electric field to move the toner in a direction from the image carrying member toward the nip forming member is formed in the transfer nip, and wherein at the peak Vr, an electric field to move the toner in a direction from the nip forming member toward the image carrying member is formed in the transfer nip, wherein the Vr and Vt are computed based on the detection bias voltage at the transfer nip, and then the peak-to-peak voltage of the AC component and the voltage of the DC component are computed using the computed Vr and Vt.

6. The image forming apparatus of claim 1, wherein the transfer bias outputting unit is configured to output a transfer bias composed of a DC component subjected to constant current control and an AC component subjected to constant voltage control, wherein a voltage of the AC component is controlled based on the detection bias voltage detected at the transfer nip.

7. The image forming apparatus of claim 1, wherein the peak-to-peak voltage of the AC component and duty of the AC component are changed based on the detection bias voltage detected at the transfer nip.

8. The image forming apparatus of claim 7, wherein the greater the absolute value of the voltage of the detected bias voltage at the transfer nip, the greater the peak-to-peak voltage of the AC component, and the smaller the duty of the AC component.

9. The image forming apparatus of claim 1, wherein the constant current control is conducted when the image carrying member is not used for a transfer process.

10. The image forming apparatus of claim 1, wherein the constant current control is conducted after the toner image is transferred from the image carrying member to the recording medium for a given number of times for a given number of recording media.

11. The image forming apparatus of claim 1, wherein the constant current control is conducted upon completing a print job.

12. The image forming apparatus of claim 1, wherein the constant current control is conducted when a given time elapses from a most recent constant current control and before starting a next print job.

13. The image forming apparatus of claim 1, wherein activation of the constant current control is determined using a default detection bias voltage set for the transfer nip and stored in advance, wherein when a difference between the detection bias voltage detected at the transfer nip before starting a print job and the default detection bias voltage set for the transfer nip exceeds a given level, at least one of the voltage of AC component or voltage of the DC component of the transfer bias is controlled.

14. The image forming apparatus of claim 1, further comprising a temperature and humidity detector configured to detect temperature and humidity around the transfer nip, wherein the constant current control is conducted when the temperature and humidity detector detects that the temperature around the transfer nip is outside of a given temperature range, and then at least one of the voltage of AC component and the voltage of the DC component is controlled.

15. The image forming apparatus of claim 1, wherein the peak-to-peak of the AC component is at least four times greater than the absolute value of voltage of the DC component.

16. The image forming apparatus of claim 1, wherein the transfer bias outputting unit is configured to output a transfer bias such that "$f>(4/d)\times v$,"

where f (Hz) is frequency of the AC component, d (mm) is a nip width defined as a length of surface moving direction of the image carrying member in the transfer nip, and v (mm/s) is a surface moving speed of the image carrying member.

* * * * *